US009916968B1

(12) United States Patent
Kurulugama et al.

(10) Patent No.: US 9,916,968 B1
(45) Date of Patent: Mar. 13, 2018

(54) IN-SOURCE COLLISION-INDUCED HEATING AND ACTIVATION OF GAS-PHASE IONS FOR SPECTROMETRY

(71) Applicant: Agilent Technologies, Inc., Santa Clara, CA (US)

(72) Inventors: Ruwan T. Kurulugama, Livermore, CA (US); George Stafford, Jr., San Jose, CA (US); Timothy Woods, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/365,935

(22) Filed: Nov. 30, 2016

Related U.S. Application Data

(60) Provisional application No. 62/378,164, filed on Aug. 22, 2016.

(51) Int. Cl.

| | |
|---|---|
| ***H01J 49/06*** | (2006.01) |
| ***H01J 49/26*** | (2006.01) |
| ***H01J 49/00*** | (2006.01) |
| ***H01J 49/10*** | (2006.01) |

(52) U.S. Cl.
CPC ..... *H01J 49/005* (2013.01); *H01J 49/10* (2013.01)

(58) Field of Classification Search
CPC ..... H01J 49/062; H01J 49/065; H01J 49/066; H01J 49/067; H01J 49/167; H01J 49/24; H01J 49/26; H01J 49/401; H01J 49/42; G01N 27/622
USPC ..... 250/281, 282, 288, 306, 307
See application file for complete search history.

(56) References Cited

U.S. PATENT DOCUMENTS

| | | | | |
|---|---|---|---|---|
| 5,349,186 | A * | 9/1994 | Ikonomou | G01N 30/7266 250/288 |
| 9,053,915 | B2 * | 6/2015 | Ristroph | H01J 49/062 |
| 9,281,173 | B2 * | 3/2016 | Mordehai | H01J 49/062 |
| 9,324,548 | B1 * | 4/2016 | Benter | H01J 49/06 |
| 9,601,323 | B2 * | 3/2017 | Nishiguchi | H01J 49/062 |
| 2017/0271140 | A1 * | 9/2017 | Okumura | H01J 49/401 |
| 2017/0287691 | A1 * | 10/2017 | Asano | H01J 49/42 |

* cited by examiner

*Primary Examiner* — David A Vanore

(57) ABSTRACT

An electrode assembly is provided in a high sub-atmospheric pressure region of an ion source, between an ionization chamber and a vacuum region of a spectrometer, such as a mass spectrometer, an ion mobility spectrometer, or an ion mobility-mass spectrometer. The electrode assembly is spaced at a distance from an outlet of an ion transfer device. A voltage source imparts a potential difference between the ion transfer device and the electrode assembly to accelerate ions emitted from the outlet to a collision energy. The collision energy is effective to cause collisional heating of ions in the high sub-atmospheric pressure region without voltage breakdown. The collision energy may be set to cause unfolding of folded biomolecular ions and/or dissociation of ions.

20 Claims, 11 Drawing Sheets

IN-SOURCE COLLISION-INDUCED HEATING AND ACTIVATION OF GAS-PHASE IONS FOR SPECTROMETRY

RELATED APPLICATIONS

This application claims the benefit under 35 U.S.C. § 119(e) of U.S. Provisional Application No. 62/378,164, filed Aug. 22, 2016, the entire content of which is incorporated herein by reference.

TECHNICAL FIELD

The present invention relates generally to ion mobility spectrometry (IMS), mass spectrometry (MS), and ion mobility-mass spectrometry (IM-MS), and more specifically to the method development and implementation of ion activation in IMS, MS, and IM-MS systems.

BACKGROUND

A mass spectrometry (MS) system in general includes an ion source for ionizing components of a sample under investigation, a mass analyzer for separating the gas-phase ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass spectrum may be utilized to determine the molecular structures of components of the sample, thereby enabling the sample to be qualitatively and quantitatively characterized. One popular type of MS is the time-of-flight mass spectrometer (TOF MS). A TOF MS utilizes a high-resolution mass analyzer (TOF analyzer). Ions may be transported from the ion source into the TOF entrance region through a series of ion guides, ion optics, and various types of ion processing devices. The TOF analyzer includes an ion accelerator that injects ions in packets (or pulses) into an electric field-free flight tube. In the flight tube, ions of differing masses travel at different velocities and thus separate (spread out) according to their differing masses, enabling mass resolution based on time-of-flight.

Ion mobility spectrometry (IMS) is a gas-phase ion separation technique in which ions produced from a sample in an ion source are separated based on their differing mobilities through a drift cell of known length that is filled with an inert gas of known composition and maintained at a known gas pressure and temperature. In low-electric field drift-type IM, the ions are urged forward through the drift cell under the influence of a relatively weak, uniform DC voltage gradient, for example in a range from 10 V/cm to 20 V/cm. The mobility of the ions depends largely on their collision cross-sections (CCSs) (and thus size and conformation or shape) and charge states (e.g., +1, +2, or +3), and to a much lesser extent their m/z ratios. Thus, ion separation by IM is largely orthogonal to ion separation by MS. From the drift cell the ions ultimately arrive at an ion detector, and the output signals from the ion detector are processed to generate peak information useful for distinguishing among the different analyte ion species detected. If the time that ions spent in the drift tube region is known and also the pressure and the voltage across the drift tube are known, then CCS can be calculated for any ion of interest. The CCS parameter is specific for the given molecule, instrument independent, and therefore can be utilized as a unique parameter for compound identification. Hence, the CCS parameter is of great interest in structural characterization of molecules and theoretical molecular dynamic simulations as well as in some other disciplines of science.

An IMS system may be coupled online with a mass analyzer, which often is a TOF analyzer. In the combined IM-MS system, ions are separated by mobility prior to being transmitted into the mass analyzer where they are then mass-resolved. Due to the significant degree of orthogonality between IM-based separation and MS-based separation, performing the two separation techniques in tandem is particularly useful in the analysis of complex chemical mixtures, including high-molecular weight (MW) biomolecules (biopolymers) such as polynucleotides, proteins, carbohydrates and the like. For example, the added dimension provided by the IM separation may help to separate ions that are different from each other (e.g., in shape) but present overlapping mass peaks. On the other hand, the added dimension provided by the MS separation may help to separate ions that have different masses but similar CCSs. This hybrid IM-MS separation technique may be further enhanced by coupling it with liquid chromatography (LC) or gas chromatography (GC) techniques. An IM-MS system is thus capable of acquiring multi-dimensional (IM-MS) data from a sample, characterized by acquisition time (i.e., chromatographic time or retention time), ion abundance (e.g., ion signal intensity), ion drift time through the IM drift cell, and m/z ratio as sorted by the MS.

An ion may activated through collision with a neutral gas molecule with a high enough collision energy to result in collisional heating, as opposed to collisional cooling, of the ion. With a high enough collision energy, ion activation can fragment the ion. This mechanism of ion fragmentation is typically implemented in a collision cell, and is referred to as collision-induced dissociation (CID) or collision-activated dissociation (CAD). Ion activation may also be utilized to cause a folded protein ion or other large biomolecular ion to unfold, which may be referred to as collision-induced unfolding (CIU). Ion activation followed by ion mobility separation is a powerful technique to identify closely related ions that can be difficult to identify using other techniques including ion mobility or mass spectrometry alone.

The hybrid IM-MS instruments currently available do not have an ion activation mechanism in the ion source that can achieve enough energy to unfold larger biomolecules or de-cluster larger biomolecules. Many commercial mass spectrometers can be equipped with a capillary-skimmer interface that couple the atmospheric pressure ionization region of the ion source with the first vacuum region in the mass spectrometer to allow moderate ion activation. Such a simple capillary-skimmer interface cannot provide high enough energy for collisional activation or fragmentation of larger bio-molecules. The typical pressure in a capillary-skimmer interface is less than 1 Torr. At higher pressures, this simple capillary-skimmer interface cannot provide high enough collision energy before electrical discharge. Therefore, larger bio-molecules cannot be activated, fragmented or unfolded using a simple capillary-skimmer interface.

Mass spectrometers that employ an ion funnel interface to couple the atmospheric pressure ionization region with the high vacuum region do not have a capillary-skimmer interface. Instead, the capillary is directly connected to a sub-atmospheric pressure region of the vacuum chamber containing the ion funnel apparatus. Here the capillary could be inline or orthogonal to the ion funnel axis. When the capillary is orthogonal to the ion funnel axis, an ion deflector plate is used to direct ions into the ion funnel. For a capillary-ion funnel interface it is even more difficult to achieve ion activation due to the high pressure at which ion funnels are operated as well as the mechanical design.

Therefore, there is a need for providing improved in-source ion activation, unfolding, and fragmentation in a high-pressure region of a mass spectrometer or other analytical device such as a stand-alone ion mobility spectrometer. There is also a need for providing improved desolvation and declustering of analyte ions prior to mass spectrometry analysis.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion source includes: an atmospheric-pressure ionization chamber; a reduced-pressure chamber configured for maintaining a high sub-atmospheric pressure therein; an ion transfer device comprising an inlet in the ionization chamber and an outlet in the reduced-pressure chamber, and defining an ion path from the inlet to the outlet; an electrode assembly comprising at least a first electrode positioned in the reduced-pressure chamber at an outlet-electrode distance from the outlet; and a voltage source configured for imparting a potential difference between the ion transfer device and the electrode assembly to accelerate ions emitted from the outlet to a collision energy, wherein the collision energy is effective to cause collisional heating of ions in the reduced-pressure chamber without voltage breakdown.

According to another embodiment, the voltage source is configured for imparting the potential difference high enough to raise the collision energy to a value effective to promote desolvation of solvated ions emitted from the outlet, a value effective to promote declustering of cluster ions emitted from the outlet, a value effective to unfold folded biomolecular ions emitted from the outlet by collision-induced unfolding, a value effective to unfold folded biomolecular ions emitted from the outlet by collision-induced unfolding without dissociating the biomolecular ions, or a value effective to dissociate ions emitted from the outlet by collision-induced dissociation.

According to another embodiment, a spectrometry system includes: an ion source according to any of the embodiments disclosed herein; a vacuum housing configured for receiving ions from the reduced-pressure chamber; and an ion analyzer in the vacuum housing.

According to another embodiment, a method for analyzing a sample includes: performing atmospheric-pressure ionization to produce ions from the sample in an ionization chamber; transferring the ions into a reduced-pressure chamber maintained at a high sub-atmospheric pressure; and subjecting the ions transferred into the reduced-pressure chamber to an electric field that accelerates the ions to a collision energy, wherein the collision energy is effective to cause collisional heating of ions in the reduced-pressure chamber without voltage breakdown.

According to another embodiment, a spectrometry system includes at least a processor and a memory configured for performing all or part of any of the methods disclosed herein.

According to another embodiment, a spectrometry system includes: a controller; and an ion detector communicating with the controller, wherein the spectrometry system is configured for performing all or part of any of the methods disclosed herein.

According to another embodiment, a non-transitory computer-readable storage medium includes instructions for performing all or part of any of the methods disclosed herein.

According to another embodiment, a system includes the computer-readable storage medium.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As used herein, the term "atmospheric pressure" is not limited to exactly 760 Torr, or one atmosphere (1 atm), but instead generally encompasses a range around 760 Torr (e.g., 100 to 900 Torr).

The present disclosure describes apparatuses and methods for improved ion activation and fragmentation and collision-induced unfolding (CIU) of proteins and other biomolecules for structural analysis in conjunction with mass spectrometry (MS), ion mobility spectrometry (IMS), and hybrid ion mobility-mass spectrometry (IM-MS) instrumentation. The apparatuses and methods described herein provide high ion activation energies in high gas pressure regions (e.g., about 0.5 Torr to about 30 Torr), which allow unfolding of large proteins and biomolecules. According to an aspect of the present disclosure, such high ion activation energies may be achieved in high gas pressure regions while avoiding voltage breakdown. The ion activation and unfolding may be implemented, for example, prior to ion mobility separation with or without coupling to mass spectrometry. The ion activation may also be utilized to improve de-solvation and de-clustering of gas-phase ions prior to ion mobility separation with or without mass spectrometry analysis, or prior to mass spectrometry analysis without prior ion mobility separation. The ion activation may also be implemented prior to ion mobility separation to enable the determination of arrival time distribution or collision cross section (CCS) changes that accompany ion unfolding patterns for biomolecules.

Figure 1:
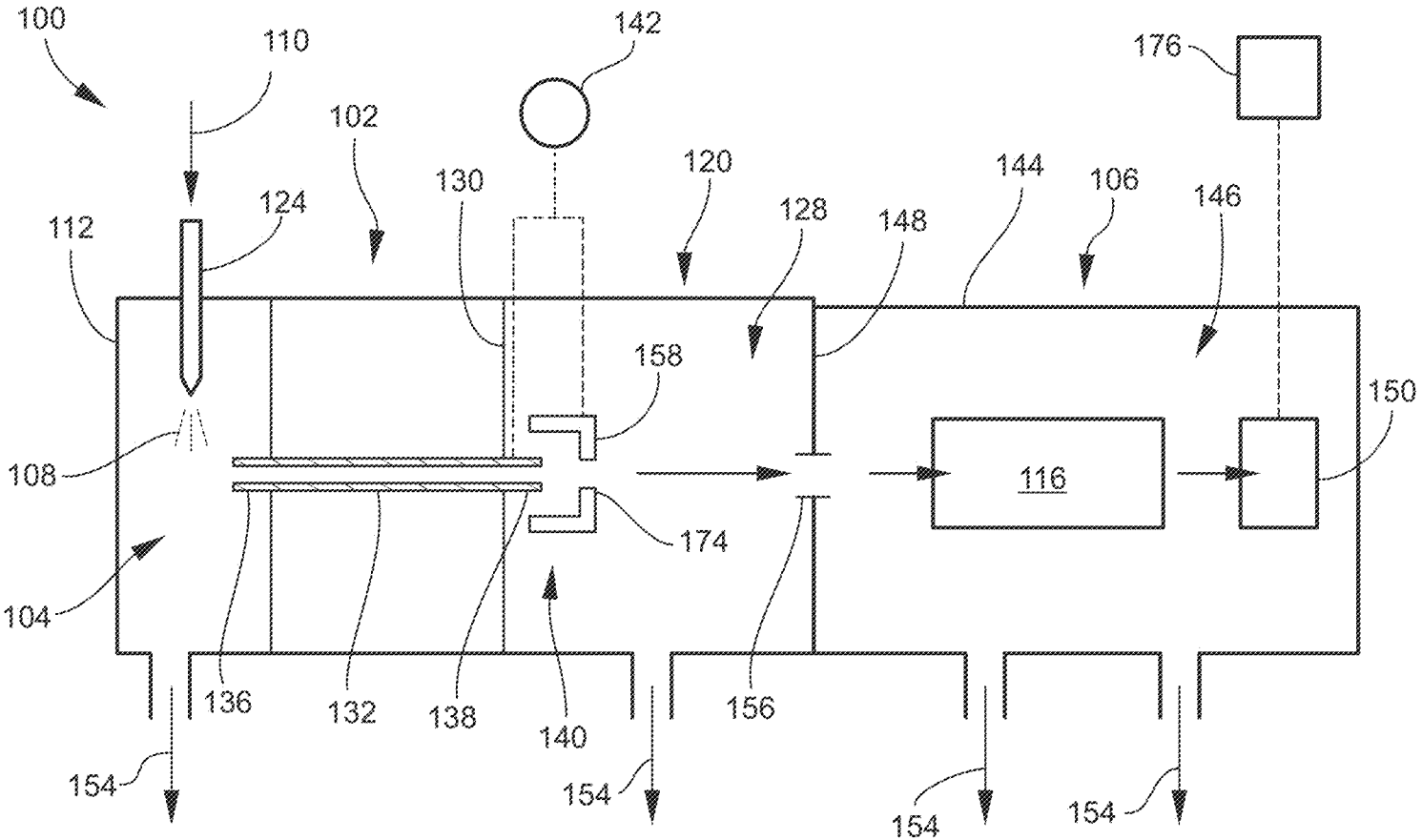
FIG. 1 is a schematic view of an example of a spectrometry system or instrument according to an embodiment disclosed herein.

FIG. 1 is a schematic view of an example of a spectrometry system or instrument 100 according to an embodiment. The operation and design of various components of spectrometry systems, including mass spectrometry (MS), ion mobility spectrometry (IMS), and hybrid ion mobility-mass spectrometry (IM-MS) systems, are generally known to persons skilled in the art and thus need not be described in detail herein. Instead, certain components are briefly described to facilitate an understanding of the subject matter presently disclosed.

The spectrometry system 100 may generally include, in series of ion process flow, an ion source 102 configured to produce gas-phase ions 108 from a sample 110 introduced into the ion source 102, and a spectrometer 106 configured to receive ions from ion source 102 and process the ions as needed to produce analytical data descriptive of the ions and thus components of the original sample 110. Horizontal arrows in FIG. 1 indicate the general or resultant direction of ions through the spectrometry system 100.

The ion source 102 may generally include an outer housing 112 enclosing an ionization chamber 104 in which ions 108 are produced, and an ion source-spectrometer interface 120 configured to receive the ions and transfer them into the spectrometer 116. One or more ionization devices 124 are configured (and positioned) to ionize components of the sample 110 in the ionization chamber 104. The ionization chamber 104 may be maintained at (or about) atmospheric pressure. The interface 120 includes one or more reduced-pressure chambers 128 (or a chamber with one or more reduced-pressure regions) configured to reduce the gas pressure relative to the ionization chamber 104, and collect and compress the ions as a beam in preparation for transferring the ions into the spectrometer 106. One or more internal walls 130 provide a physical boundary between the ionization chamber 104 and the (first) reduced-pressure chamber 128. The reduced-pressure chamber 128 is maintained at a reduced pressure, also referred to herein as a high sub-atmospheric pressure. In the present context, a high sub-atmospheric pressure is a pressure lower than the pressure maintained in the ionization chamber 104, but higher than the vacuum level of pressure maintained in the spectrometer 106. As one non-limiting example, the high sub-atmospheric pressure is in a range from about 0.5 Torr to about 30 Torr.

The ion source 102 further includes an ion transfer device 132 configured (and positioned) to transfer ions (and neutral gas molecules) from the ionization chamber 104 to the reduced-pressure chamber 128. For this purpose, the ion transfer device 132 includes an inlet 136 fluidly communicating with the ionization chamber 104 and an outlet 138 fluidly communicating with the reduced-pressure chamber 128. The ion transfer device 132 extends from the inlet 136, through one or more internal walls 130 between the ionization chamber 104 and the reduced-pressure chamber 128, and to the outlet 138. The ion transfer device 132 thus defines an ion path from the inlet 136 to the outlet 138. The ion source 102 further includes an electrode assembly 140 positioned in the reduced-pressure chamber 128. A voltage source 142, provided by appropriate electronics of the spectrometry system 100, is in electrical communication with the outlet 138 of the ion transfer device 132 and the electrode assembly 140. Representative embodiments of the ion transfer device 132 and the electrode assembly 140 are described in more detail below.

The spectrometer 106 may generally include an outer housing (or vacuum housing) 144 configured for receiving ions from the reduced-pressure chamber 128. The vacuum housing 144 encloses one or more vacuum chambers 146. An ion analyzer 116 and an ion detector 150 are positioned in at least one of the vacuum chambers 146. In one embodiment, the spectrometer 106 is a mass spectrometer (MS) configured to produce ion mass spectra, in which case the ion analyzer 116 includes at least one mass (m/z) analyzer. In another embodiment, the spectrometer 106 is an ion mobility spectrometer (IMS) configured to produce ion drift spectra and calculate ion collision cross-section (CCS), in which case the ion analyzer 116 includes at least one ion mobility (IM) drift cell. In FIG. 1, the ion analyzer 116 may also be schematically representative of other ion processing devices, which may include additional ion analyzers. Thus, in another embodiment, the spectrometer 106 is a hybrid ion mobility-mass spectrometry (IM-MS) instrument configured to produce two-dimensional IM-MS spectral data. In this case, the ion analyzer 116 includes a first ion analyzer followed by a second ion analyzer configured for receiving ions from the first ion analyzer. The first ion analyzer may be an IM drift cell and the second ion analyzer may be a mass analyzer. In another embodiment, an ion fragmentation device may be positioned between the first ion analyzer and the second ion analyzer, enabling the spectrometer 106 to produce fragment ion spectra. In this case, the first ion analyzer may be a mass analyzer (e.g., a mass filter) configured to select precursor ions for fragmentation, and the second ion analyzer may be a (final) mass analyzer configured to mass-resolve product ions produced from the precursor ions in the ion fragmentation device. In another embodiment, the spectrometer 106 includes an IM drift cell followed by a mass analyzer, followed by an ion fragmentation device, and followed by a (final) mass analyzer. In another embodiment, the IM drift cell may be configured as a trapped ion mobility spectrometry (TIMS) tunnel, which is configured to selectively release the ions from the tunnel according to their mobility.

At least one internal wall 148 provides a physical boundary between the (last) reduced-pressure chamber 128 of the ion source 102 and the (first) vacuum chamber 146 of the spectrometer 106. Depending on the types of ion processing devices operating in the spectrometer 106 and the number of distinct vacuum chambers 146 provided, different vacuum levels may be maintained in different regions of the vacuum housing 144. For example, an IM drift cell may be "pressurized" to a drift gas pressure in a range from, for example, 1 to 10 Torr. More generally, an IM drift cell may be configured to operate at pressures up to atmospheric pressure. Accordingly, an IM drift cell appropriately located in the spectrometry system 100 may operate in a range from about 1 Torr to about 750 Torr. On the other hand, a mass analyzer may operate at a pressure in a range from, for example, $10^{-4}$ to $10^{-9}$ Torr. The spectrometry system 100 includes a vacuum system configured to maintain the various regions of the spectrometry system 100 at the required pressure levels and remove non-analytical neutral molecules from the ion path, as schematically represented in FIG. 1 by arrows 154 and associated ports communicating with corresponding chambers. For this purpose, the vacuum system may include various (ports, conduits, pumps, etc.) as appreciated by persons skilled in the art.

An opening 156 through the wall 148 provides a path for ions to transit into the vacuum chamber 146. Various ion optics may define or be positioned near the opening 152. For example, it is common to provide a skimmer cone (or sampling cone) positioned at or defining the opening 152. While a skimmer cone could be provided in embodiments taught herein, a skimmer cone is not needed, as will become evident from further description herein.

Generally, the ion transfer device 132 may take on various forms. In a typical example contemplated for the present disclosure, the ion transfer device 132 is or includes a capillary tube. The geometry of a capillary tube may be desirable for various reasons. The small diameter of the bore of a capillary tube acts as a gas conductance barrier that facilitates maintaining a pressure differential between the higher-pressure ionization chamber 104 and the lower-pressure reduced-pressure chamber 128, and reduces the amount of gas molecules transferred into the reduced-pressure chamber 128 with the ions. In addition, the length of a capillary tube may provide an opportunity for desolvation and declustering of ions and evaporation of neutral droplets to occur in the capillary tube. Such mechanisms may be enhanced by providing a heating device (not shown) in thermal contact with the capillary tube. In some embodiments, the capillary tube may be composed of glass. In some embodiments, the capillary tube may include resistive or conductive elements at or near the inlet 136 and the outlet 138 to enable a potential difference to be imparted across the capillary tube.

The electrode assembly 140 may include one or more electrodes (counter-electrodes) 158 positioned in the reduced-pressure chamber 128 at predetermined (desired) axial distances from the outlet 138 (e.g., capillary exit) of the ion transfer device 132. In the present context, the term "axial" relates to the longitudinal axis along which the ion transfer device 132 is arranged, which also generally corresponds to the axis along which the ions travel from the outlet 138. Each electrode 158 may include an electrode aperture 174 positioned on-axis at a predetermined axial distance from the outlet 138. As a non-limiting example, the outlet-electrode distance—namely, the axial distance between a single electrode 158 and the outlet 138 in a single-electrode embodiment, or the first electrode 158 and the outlet 138 in a multi-electrode embodiment—is in a range from about 0.5 mm to about 3.0 mm. Each electrode 158 may be or include a planar section. The planar section may be an "apertured" plate, i.e., a plate through which the electrode aperture 174 is formed. Alternatively, the planar section may be a "gridded" electrode, i.e., formed by a grid or mesh of wires. One or more of the electrodes 158 may also include a cylindrical section adjoining the planar section and coaxial with the axis. The cylindrical section may coaxially surround the outlet 138. Each electrode 158 may be individually addressable by the voltage source 142 so that different electrostatic potentials may be applied to different electrodes 158. The electrode assembly 140 may also include structural components (including electrically insulating components) as needed for mounting the electrode assembly 140 in a fixed position in the reduced-pressure chamber 128, as appreciated by persons skilled in the art.

The voltage source 142 is configured for imparting a predetermined (desired) potential difference between the ion transfer device 132 (e.g., the outlet 138 thereof) and the electrode assembly 140 to accelerate ions emitted from the outlet 138 to a predetermined (desired) collision energy at which the ions collide with neutral gas molecules in the reduced-pressure chamber 128. In the case of a single electrode 158, the voltage source 142 is operated to impart a potential difference between the ion transfer device 132 and that electrode 158. The magnitude of the potential difference may be selected so that the collision energy is effective to cause collisional heating/activation of ions in the reduced-pressure chamber 128 without voltage breakdown, for a given pressure and outlet-electrode distance. As a non-limiting example, the voltage source 142 is configured for imparting the potential difference in a range between about 0 V to about 1000 V.

The magnitude of the potential difference may be selected so that the collision energy is effective to implement a desired modality of ion activation. As examples, the collision energy may be raised or adjusted to a value effective to promote desolvation of solvated ions emitted from the outlet 138, and/or to promote declustering of cluster ions emitted from the outlet 138. Additionally, the collision energy may be raised or adjusted to a value effective to dissociate ions emitted from the outlet 138 by collision-induced dissociation (CID). Additionally, the collision energy may be raised or adjusted to a value effective to unfold folded biomolecular ions emitted from the outlet 138 by collision-induced unfolding (CIU), with or without also dissociating the biomolecular ions, as desired in a particular application. According to an aspect of the present disclosure, electrode assembly 140 is configured to enable all such modalities to be carried out in a high-pressure environment, for example in a range from about 0.5 Torr to about 30 Torr as specified elsewhere herein, without causing undesirable electrical discharge by voltage breakdown. The outlet-electrode distance may be set or adjusted as needed to prevent voltage breakdown in view of the ranges of pressure and collision energies contemplated for a given application, and/or to optimize conditions for a particular modality of ion activation.

The spectrometry system 100 may also include a controller (or system controller, or computing device) 176 configured for controlling or monitoring various components and functions of the spectrometry system 100. For example, the controller 176 may control, or execute a preprogrammed operation of, the voltage source 142 and consequently control the electric fields and collision energies realized in the reduced-pressure chamber 128 of the ion source 102.

The configuration of the ion transfer device 132 and the electrode assembly 140 allows obtaining a very high electric field at the outlet 138 (e.g., capillary exit) of the ion transfer device 132, improving certain collision-based activities in comparison to conventional ionization-spectrometer interfaces and enabling other collision-based activities not practical or possible in conventional ionization-spectrometer interfaces. The ion transfer device 132 and the electrode assembly 140 operate in a higher pressure regime in comparison to conventional capillary-skimmer interfaces. A skimmer is not needed in embodiments of the present disclosure.

The ion transfer device 132 and the electrode assembly 140 may operate in conjunction with other ion processing devices provided in the reduced-pressure chamber(s) 128, such as ion guides and ion funnel-based devices such as described below in conjunction with FIG. 3. An ion guide in the reduced-pressure chamber may be configured for generating a radio frequency electric field effective for limiting radial motion of ions relative to an ion guide axis, and/or for generating a direct-current potential gradient along the ion guide axis. The ion guide may include an ion guide entrance and an ion guide exit spaced from the ion guide entrance along the ion guide axis. The ion guide entrance may surround at least a portion of the electrode assembly 140. The outlet 138 of the ion transfer device 132 may be positioned on an outlet axis radially offset from the ion guide axis. The ion guide may include a plurality of ion guide electrodes spaced from each other along the ion guide axis and including a plurality of respective ion guide apertures. The ion guide may include or be configured as an ion funnel, or as another type of stacked-ring ion guide such as an S-lens. Another example is a conjoined ion guide that includes two stacked-ring ion guides having different diameters. The axes of the two stacked-ring ion guides are parallel, but offset, to each other such that one stacked-ring ion guide is positioned above the other stacked-ring ion guide. The ring electrodes of the two stacked-ring ion guides are slotted, i.e., they are not complete rings but instead have open gaps. The gaps of the lower stacked-ring ion guide face upward, and the gaps of the upper stacked-ring ion guide face downward and thus face the gaps of the lower stacked-ring ion guide. Ions enter the lower stacked-ring ion guide and shift upward through the gaps and into the upper stacked-ring ion guide, under the influence of a DC potential difference.

The reduced-pressure chamber(s) 128 may include a plurality of ion guides, such as a first ion guide positioned along a first ion guide axis and a second ion guide positioned along a second ion guide axis and configured to receive ions from the first ion guide. The second ion guide may be configured for generating an electric field effective for trapping ions in the second ion guide for a controllable period of time. The second ion guide may include or be configured as an ion funnel. The second ion guide may include a plurality of ion guide electrodes spaced from each other along the ion guide axis and including a plurality of respective ion guide apertures. The second ion guide axis may be radially offset from the first ion guide axis.

In addition, the ion transfer device 132 and the electrode assembly 140 may operate in conjunction with operating a collision cell in the spectrometer 106. Methods may be developed for the use of both the electrode assembly 140 and a collision cell for ion activation to yield additional information regarding ions not possible or readily ascertainable from the use of either the electrode assembly 140 or the collision cell alone.

An example of a method for analyzing a sample will now be described with reference to FIG. 1. The ion source 102 is operated to perform atmospheric-pressure ionization to produce ions from the sample in the ionization chamber 104. The ions are transferred into the reduced-pressure chamber 128, which is maintained at a high sub-atmospheric pressure, via the ion transfer device 132. In the reduced-pressure chamber 128, the ions are subjected to an electric field that accelerates the ions to a collision energy through operation of the voltage source 142 and electrode assembly 140. The collision energy is effective to cause collisional heating of the ions in the reduced-pressure chamber 128 without voltage breakdown. The collision energy may be set to a value effective to perform a desired processing of the ions emitted from the outlet 138 of the ion transfer device 132 and into the reduced-pressure chamber 128. Examples include promoting desolvation of solvated ions, promoting declustering of cluster ions, fragmenting ions by collision-induced dissociation, and unfolding folded biomolecular ions by collision-induced unfolding (with or without also fragmenting the ions). The collision energy may be set by controlling the electric field, which is generated by imparting a potential difference between the ion transfer device 132 and the electrode assembly 140. The potential difference may be, for example, in a range from about 0 V to about 1000 V.

In one embodiment, after transferring the ions into the reduced-pressure chamber 128, the ions may be transferred into an ion mobility drift cell of the spectrometer 106 to separate the ions by mobility. The separated ions may then be transferred to the ion detector 150. The ion detector 150 may be utilized to measure respective arrival times of the ions at the ion detector 150 relative to a time at which the ions were transferred into the ion mobility drift cell. Based on the measured arrival times, an arrival time distribution of the ions and/or collision cross-sections of the ions may be calculated. In the case of folded biomolecular ions, these ions may first be unfolded in the reduced-pressure chamber 128 as described above, and the arrival times of the unfolded ions may be measured. As also described above, fragment ions may be produced in the reduced-pressure chamber 128, and the arrival times of the fragment ions may be measured.

In another embodiment, after transferring the ions into the reduced-pressure chamber 128, the ions may be transferred into a mass analyzer of the spectrometer 106 to separate the ions by mass-to-charge (m/z) ratio. The separated ions may then be transferred to the ion detector 150. The signals outputted from ion detector 150 may be utilized to produce a mass spectrum of the ions, which may be fragment ions produced in the reduced-pressure chamber 128 as described above.

In another embodiment, after transferring the ions into the reduced-pressure chamber 128, the ions may be transferred into an ion mobility drift cell and then into a mass analyzer of the spectrometer 106. In this way, both an ion mobility drift time spectrum and a mass spectrum of the ions may be produced.

Figure 2:
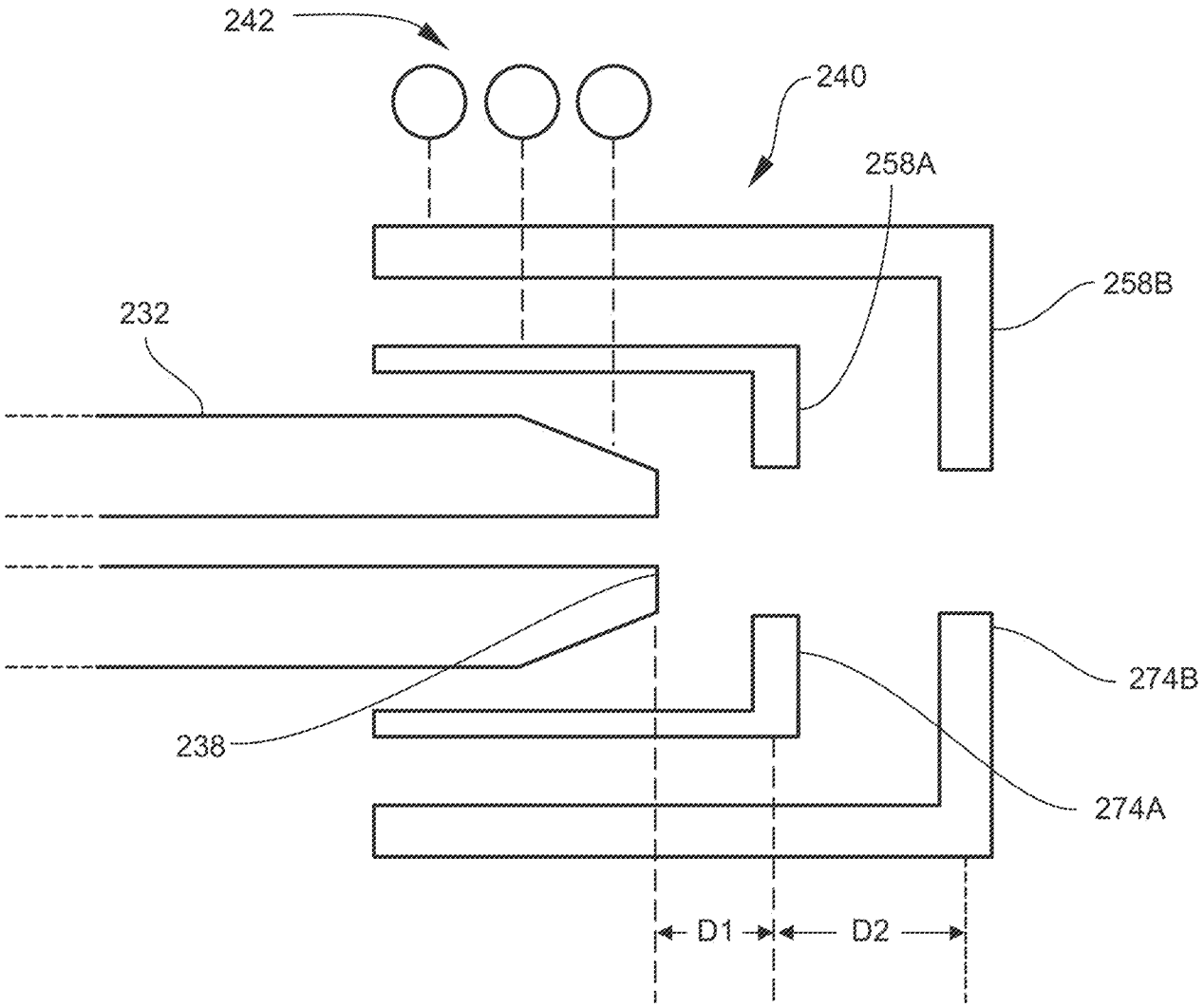
FIG. 2 is a schematic cross-sectional view of an example of an electrode assembly and the exit end of an ion transfer device according to an embodiment disclosed herein.

FIG. 2 is a schematic cross-sectional view of an example of an electrode assembly 240 and the exit end of an ion transfer device 232 according to another embodiment. The ion transfer device 232 may be or include a capillary tube as illustrated. In this embodiment, the electrode assembly 240 includes a plurality of electrodes (counter-electrodes), specifically at least a first electrode 258A and a second electrode 258B. The first electrode 258A may include a first electrode aperture 274A and the second electrode 258B may include a second electrode aperture 274B, both of which may be positioned on-axis with an outlet 238 of the ion transfer device 232. The first electrode aperture 274A is spaced from the outlet 238 by an outlet-electrode distance D1, and the second electrode aperture 274B is spaced from the first electrode aperture 274A by an electrode-electrode distance D2. As a non-limiting example, the outlet-electrode distance D1 is in a range from about 0.5 mm to about 3.0 mm, and the electrode-electrode distance D2 is in a range between about 0.5 mm to about 3.0 mm. Each electrode 258A and 258B may be or include a planar section, i.e., an "apertured" plate or a "gridded" electrode. One or both of the electrodes 258A and 258B may also include a cylindrical section adjoining the planar section and coaxial with the axis. In the illustrated embodiment, the electrodes 258A and 258B both include cylindrical sections coaxially surrounding the outlet 238 with the cylindrical section of the first electrode 258A being nested within the cylindrical section of the second electrode 258B. In the illustrated embodiment, a voltage source 242 is schematically depicted as individual voltage sources (relevant portions of electronic circuitry provided by the spectrometry system 100) communicating with the exit end of the ion transfer device 232, the first electrode 258A, and the second electrode 258B, respectively, whereby different electrostatic potentials may be respectively applied the ion transfer device 232, the first electrode 258A, and the second electrode 258B. The electrode assembly 240 may also include structural components (including electrically insulating components) as needed for mounting the first electrode 258A and the second electrode 258B in fixed positions relative to each other and to the ion transfer device 232, as appreciated by persons skilled in the art.

With two or more electrodes 258A and 258B, the electrode assembly 240 is capable of achieving higher electrics fields before electrical discharge than the single-electrode assembly 140 shown in FIG. 1. The electrode-electrode distance D2 may be adjusted to achieve higher breakdown voltages. The potential difference between the outlet 238 (e.g., capillary exit) and the first electrode 258A may be maintained at a lower voltage than the voltage between the first electrode 258A and the second electrode 258B. The average pressure in the region between the outlet 238 and the first electrode 258A is relatively high and therefore the electric field has to be kept at a minimum to avoid electrical discharge. Because the electrode spacing between the first electrode 258A and the second electrode 258B (the electrode-electrode distance D2) may be adjusted to obtain a lower average pressure, the electric field between those two electrodes 258A and 258B may be increased to obtain higher collision activation energies.

Figure 3:
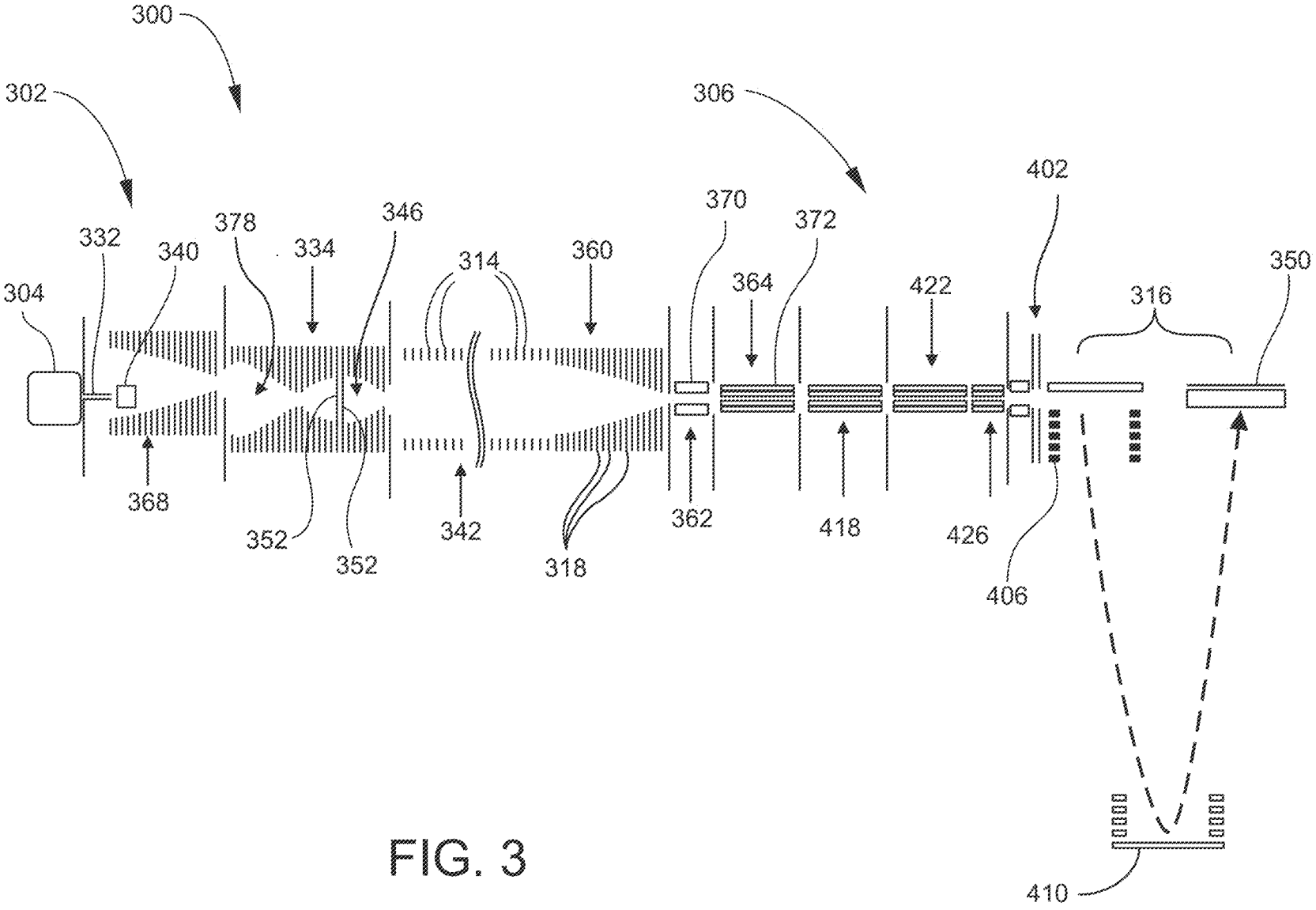
FIG. 3 is a schematic view of an example of a spectrometry system or instrument according to another embodiment disclosed herein.

FIG. 3 is a schematic view of an example of a spectrometry system or instrument 300 according to another embodiment. The spectrometry system 300 may generally include an ion source 302 and a spectrometer 306, which in the present embodiment is an IM-MS spectrometer and more specifically an IM-qTOF spectrometer. As in FIG. 1, the general direction of ion process flow is from left to right.

In the present embodiment the ion source 102 includes, in series of ion process flow, an ionization chamber 304 and an ion transfer device in the form of a capillary tube 332 leading into an ion source-spectrometer interface. The interface includes a first reduced-pressure chamber containing a high-pressure ion funnel 368, and a second reduced-pressure chamber containing an accumulating/pulsing ion trap 334. As one non-limiting example, the high sub-atmospheric pressure at which the interface operates is in a range from about 0.5 Torr to about 30 Torr. As another example, the high-pressure ion funnel 368 in the first reduced-pressure chamber may operate at a pressure in a range from about 2 Torr to about 30 Torr, and the ion trap 334 in the second reduced-pressure chamber may operate at a pressure in a range from about 1 Torr to about 20 Torr. As a further example, the ion funnel 368 may operate at a pressure of about 5.0 Torr and the ion trap 334 may operate at a pressure of about 4.0 Torr.

In the present embodiment, the high-pressure ion funnel 368 and the ion trap 334 are configured as ion funnels that include respective series of axially spaced funnel electrodes in the form of rings or plates with apertures, as appreciated by persons skilled in the art. Radio-frequency (RF) potentials are applied to the funnel electrodes in a manner that constrains the radial motions of the ions and thereby compresses the ion beam along the respective longitudinal axes of the high-pressure ion funnel 368 and the ion trap 334, and direct-current (DC) potentials are applied to the funnel electrodes so as to generate an axial DC voltage gradient to keep the ions moving in a forward direction, again as appreciated by persons skilled in the art. The ion trap 334 may include a converging entrance region 378 and a diverging/constant-diameter/converging trap region 346. Electrostatic grid electrodes 352 in the trap region 346 may be utilized to alternately trap ions in the trap region 346 and pulse ions (periodically release the ions in packets, or pulses) into the spectrometer 306. The high-pressure ion funnel 368 may be oriented non-coaxially with the ion trap 334, with the axis of the high-pressure ion funnel 368 being offset from (as illustrated) or at an angle to that of the ion trap 334. This configuration may be useful for reducing the amount of neutral species entering the trap region 346 and improving ion transmission into the trap region 346. A similar dual ion funnel system is further described in U.S. Pat. No. 8,324,565, the entire contents of which are incorporated by reference herein.

The ion source 102 further includes an electrode assembly 340 positioned proximate to the outlet of the capillary tube 332, and configured according to any of the embodiments described herein. The capillary tube 332 may extend a small distance into the entrance end of the high-pressure ion funnel 368, and thus the electrode assembly 340 may be positioned in the entrance end of the high-pressure ion funnel 368. The typical voltage between the capillary exit and the first funnel entrance electrode of the high-pressure ion funnel 368 is about 50 V. Based on this mechanical design it is difficult to obtain a high enough electric field at the capillary exit to result in collision-induced ion activation for larger biomolecules. However, the electrode assembly 340 may be operated in the entrance region of the high-pressure ion funnel 368 to readily enable collision-induced ion activation as described herein.

In the present embodiment the spectrometer 306 includes, in series of ion process flow, an IM analyzer (drift cell) 342, a rear ion funnel 360 immediately following the drift cell 342, one or more linear multipole ion guides 362 and 364 (e.g., hexapoles, octopoles, etc.) and/or other ion optics following the rear ion funnel 360, a quadrupole mass filter 418 for selecting ions, a linear multipole-based collision cell 422 for producing fragment ions, an ion beam compressor 426, entrance optics 402, a time-of-flight (TOF) analyzer 316 with entrance optics 402, and an ion detector 350. Alternatively, the mass filter 418 may precede the IM drift cell 342.

The drift cell 342 includes a plurality of drift cell electrodes 314 spaced along the longitudinal axis of the drift cell 342. In one non-limiting example, the drift cell 342 may be 0.78 m in length, operate at a drift gas (e.g., nitrogen) pressure in a range from about 1 Torr to about 10 Torr (e.g., about 4 Torr), and apply a typically uniform drift axial DC electric field gradient of 20 V/cm. The axial field gradient moves the ions through the drift cell 342 in the presence of the drift gas, whereby the ions become separated in time based on their different collision cross-sections (CCSs) as appreciated by persons skilled in the art. The controller 176 (FIG. 1) may calculate the "drift time" taken by each ion to traverse the length of the drift cell 342 based on the arrival time of the ion measured at the ion detector 350. The time scale of IM separation is typically milliseconds (ms). The rear ion funnel 360 includes a plurality of axially spaced funnel electrodes 318, which apply RF and axial DC fields as described above. The rear ion funnel 360 efficiently receives the IM-separated ions and transmits them onward into the spectrometer 306.

The multipole ion guides 362 and 364 include respective sets of axially elongated guide electrodes 370 and 372 circumferentially spaced about the respective longitudinal axes of the multipole ion guides 362 and 364. The guide electrodes 370 and 372 apply RF fields to focus ions along the axes as described above. As a non-limiting example, the multipole ion guides 362 and 364 may operate at pressures in a range from $10^{-3}$ to $10^{-5}$ Torr.

The quadrupole mass filter 418 includes a set of four parallel rod-shaped electrodes positioned at a radial distance from the central axis of the mass filter 418, and circumferentially spaced from each other around the central axis so as to surround an axially elongated interior mass filter volume leading from an ion entrance end to an axially opposite ion exit end of the mass filter 418. The mass filter 418 may be operated in a known manner to apply a composite RF/DC field tuned to allow only selected ions to pass through its ion exit end and further into the spectrometer 306. The mass filter 418 thus operates as a bandpass mass filter in which the operating parameters of the RF/DC field dictate the width ($\Delta m/z$) of the m/z passband, as well as the low m/z cutoff value and the high m/z cutoff value of the m/z passband. During some sample runs, or during some periods of time in a given sample run, the mass filter 418 may be operated as an RF-only ion guide without actively filtering the ion transmission.

The collision cell 422 typically has a linear multipole electrode configuration, and may be pressurized with a collision gas (e.g., argon, nitrogen, etc.) to a pressure effective for CID, for example, about 10 mTorr. RF potentials applied to the collision cell electrodes focus the ions toward the central axis of the collision cell 422, while an axial DC voltage applied across the length of the collision cell 422 pushes the ions forward through the collision cell 422. Precursor ions (or "parent" ions) colliding with the collision gas molecules with sufficient energy will fragment into fragment ions (or "product" or "daughter" ions). As noted above, the collision cell 422 may be actively operated as an ion fragmentation device in addition to operating the electrode assembly 340 in the ion source 302. During some sample runs, or during some periods of time in a given sample run, the collision cell 422 may be operated as an RF-only ion guide without actively inducing ion fragmentation.

The ion beam compressor 426 may include a set of multipole electrodes converging toward to the axis to enhance beam compression and provide efficient ion transmission.

In the present embodiment, the TOF analyzer 316 includes an ion accelerator 406, an evacuated (e.g., $10^{-4}$ to $10^{-9}$ Torr) TOF flight tube (not shown) oriented orthogonally to the entrance optics 402 and an electric field-free TOF flight region, an ion detector 350, and an electrostatic reflectron (or ion mirror, or Mamyrin mirror) 410. The reflectron 410 provides a 180° reflection in the ion flight path in the flight tube between the ion accelerator 406 and the ion detector 350, thereby extending the length of the flight path and correcting the kinetic energy distribution of the ions. The region containing the entrance optics 402 may be pumped down to the vacuum level of the flight tube. In operation, the ion accelerator 406 accelerates (injects) discrete packets of ions into the flight tube at a predetermined pulsing rate (or firing rate). The TOF injection pulses typically occur on a much faster time scale (microseconds (μs)) than the IM injection pulses (milliseconds (ms)). As the TOF injection rate (frequency) is thus typically much higher than the IM injection rate (frequency), many TOF injection pulses occur during the period between two sequential IM injection pulses. Each ion packet injected into the flight tube may include a range of ion masses, depending on how the preceding mass filter 418 and collision cell 422 are being operated. In each ion packet, ions of different masses (m/z ratios) travel through the flight tube at different velocities and thus have different overall times-of-flight, i.e., ions of smaller masses travel faster than ions of larger masses. Thus, each ion packet spreads out (is dispersed) in space in accordance with the time-of-flight distribution. The ion detector 350 detects and records the time that each ion arrives at (impacts) the ion detector 350. A data acquisition process implemented by the controller 176 (FIG. 1) correlates the recorded times-of-flight with m/z ratios.

It will be understood that FIGS. 1-3 are high-level schematic depictions of an example of a spectrometry system and associated components consistent with the present disclosure. Other components, such as additional structures, vacuum pumps, gas plumbing, ion optics, ion guides, electronics, and computer-related or electronic processor-related components may be included as needed for practical implementations.

Examples

Figure 4:
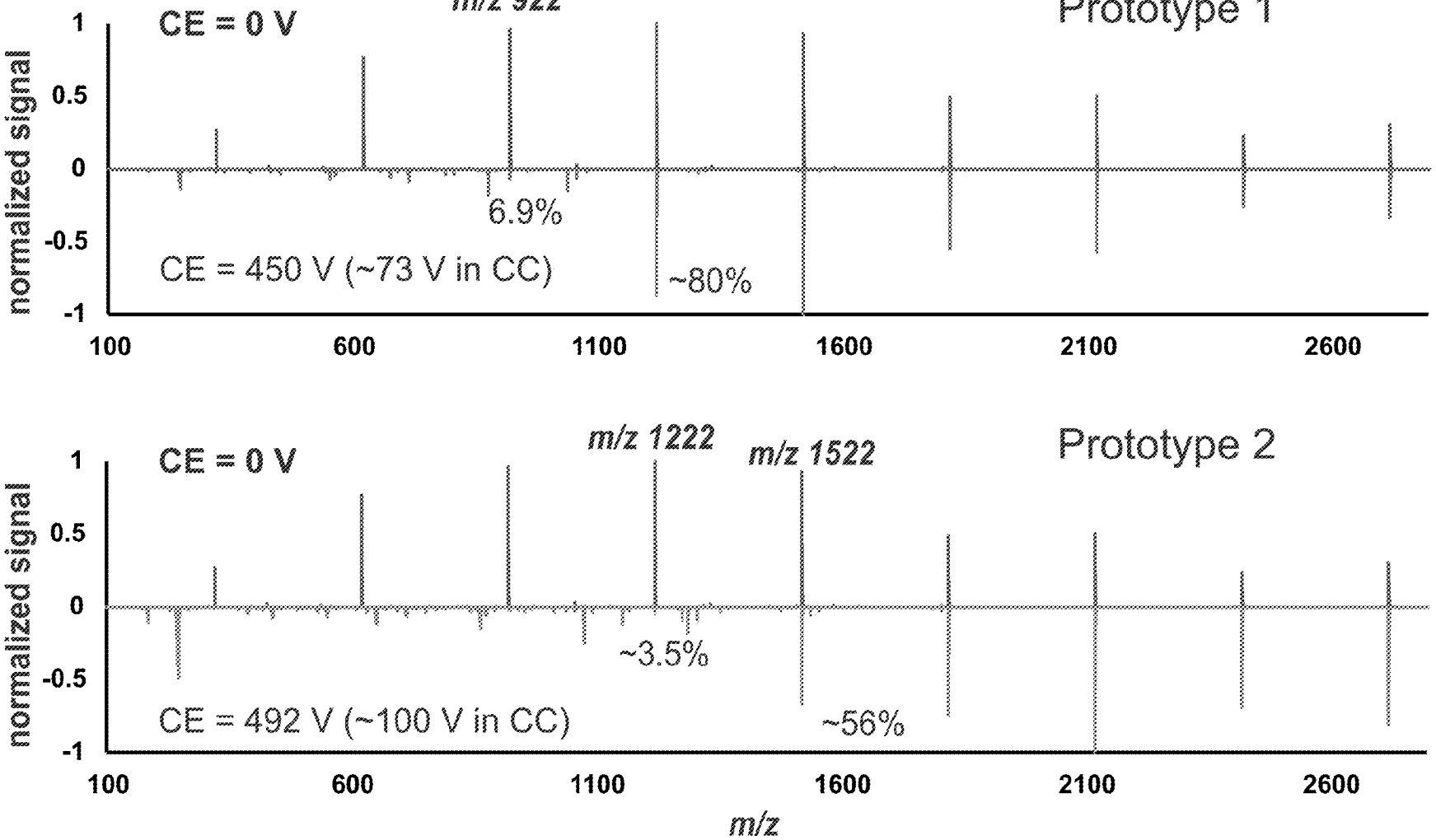
FIG. 4 shows the fragmentation spectra for tune mix ions acquired from operating a single-electrode electrode assembly disclosed herein and a two-electrode electrode assembly disclosed herein, respectively.

FIG. 4 shows the fragmentation spectra for tune mix ions acquired from operating the single-electrode electrode assembly 140 described above and illustrated in FIG. 1 (Prototype 1) and the two-electrode electrode assembly 240 described above and illustrated in FIG. 2 (Prototype 2), respectively. With the two-electrode configuration, higher collision energies are achieved, which is demonstrated by the fragmentation of higher mass ions compared to the single-electrode electrode configuration before electrical discharge. For the current single-electrode electrode configuration, 20% fragmentation of the m/z=1222 ion is achieved. However, this fragmentation efficiency can be further improved depending on the pressure regime of the system and the placement of the counter electrode with respect to the capillary exit. Similarly, the fragmentation and ion activation efficiency of the two-electrode configuration can be improved by adjusting the relative distances between the capillary exit, the first electrode, and the second electrode.

Figure 5A:
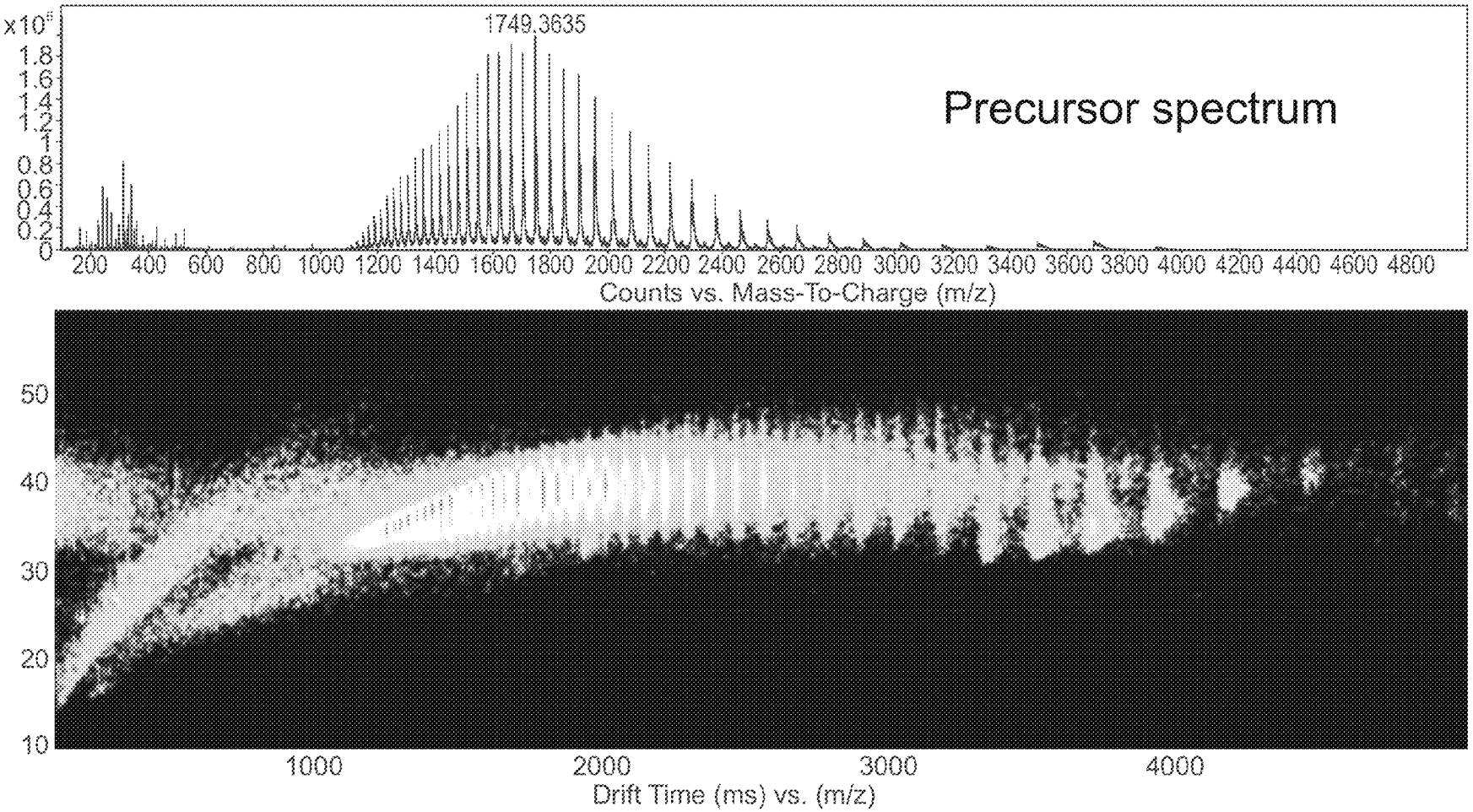
FIG. 5A shows the spectral data for precursor ions for bovine serum albumin (BSA) protein under denatured conditions, utilizing a single-electrode electrode assembly disclosed herein.
Figure 5B:
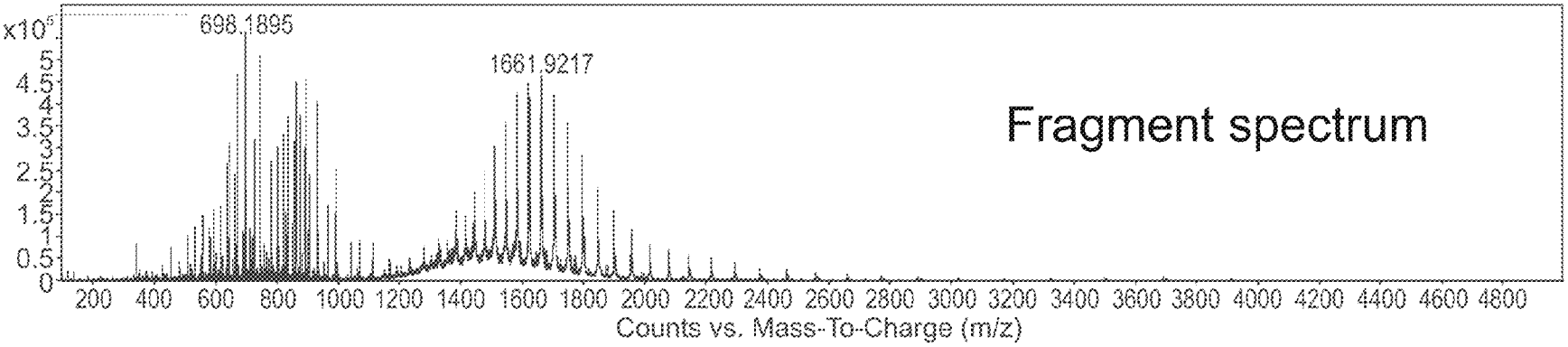
FIG. 5B shows the spectral data for fragment ions for the BSA protein utilizing the single-electrode electrode assembly.
Figure 5B:
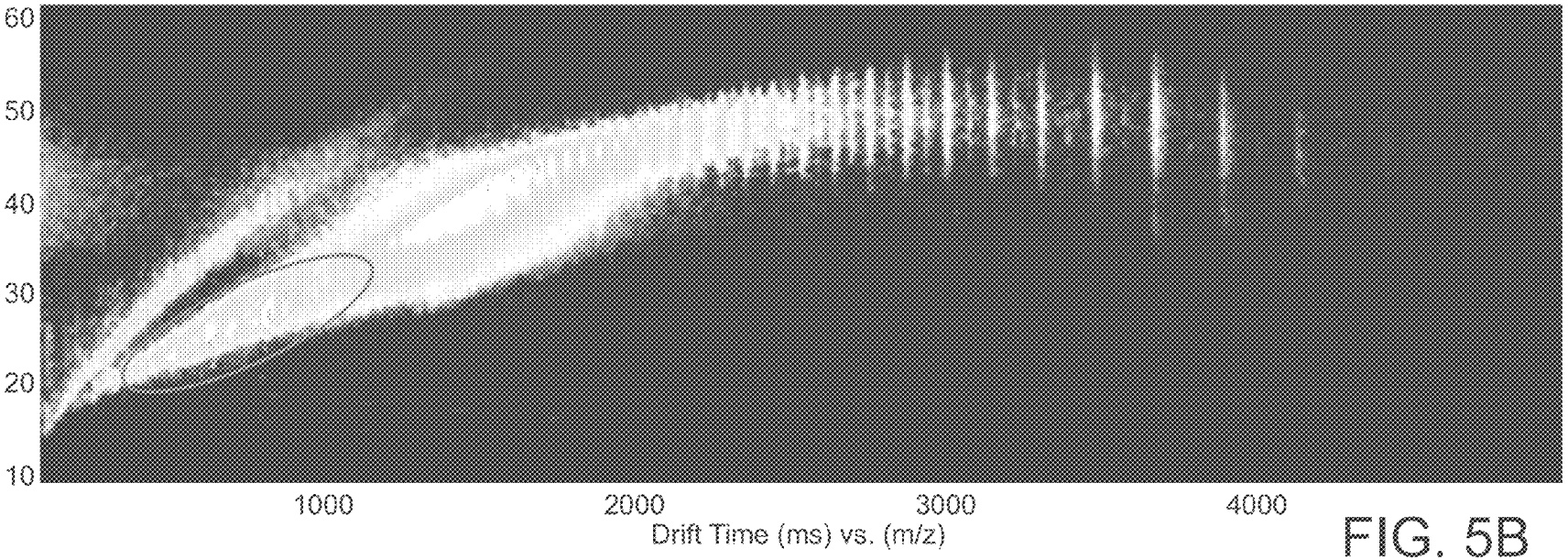

FIG. 5A shows the spectral data for precursor ions for bovine serum albumin (BSA) protein under denatured conditions. FIG. 5B shows the spectral data for fragment ions for the BSA protein. For this experiment, the single-electrode electrode assembly 140 was utilized. The fragment ion spectrum shown was obtained at 450 volts (V) collision energy (CE) between the capillary exit and the counter electrode. The precursor ion spectrum was obtained using 0 V CE.

Figure 6A:
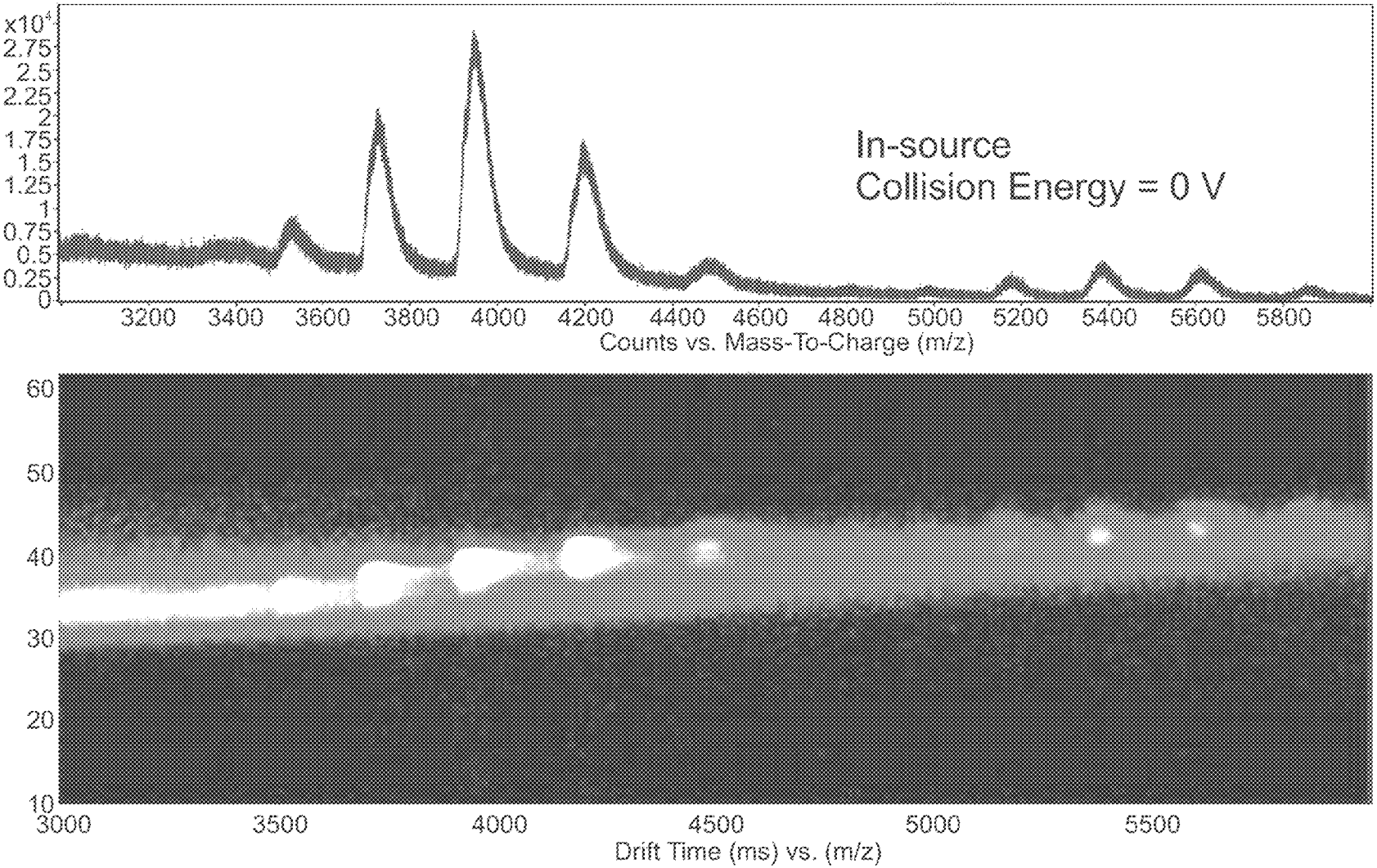
FIG. 6A shows data (drift time vs. m/z vs. abundance) produced by operating a hybrid ion mobility-mass spectrometer, with the source region operated at 0 V collision energy, according to an embodiment disclosed herein.
Figure 6B:
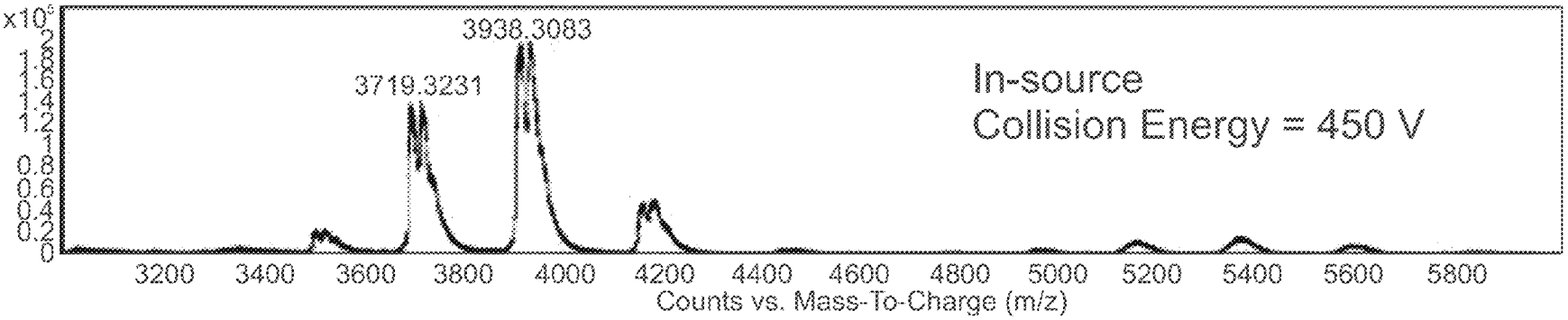
FIG. 6B shows data (drift time vs. m/z vs. abundance) produced by operating the hybrid ion mobility-mass spectrometer, with the source region operated at 450 V collision energy.
Figure 6B:
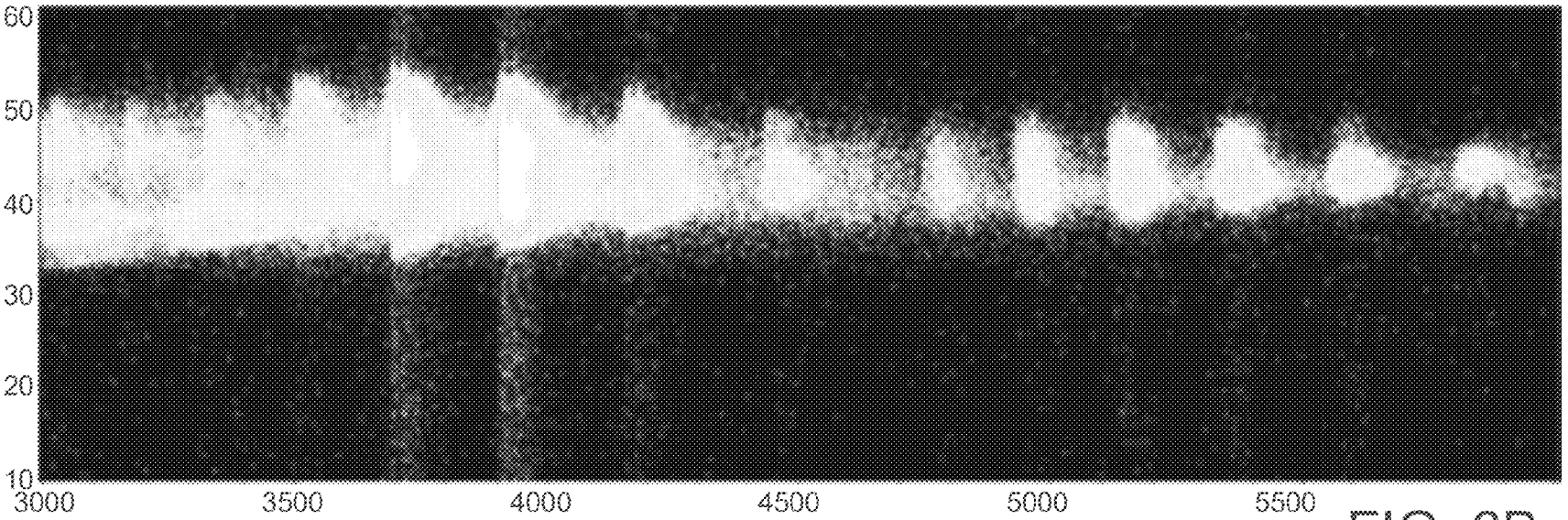

FIG. 6 shows two plots of data (drift time vs. m/z vs. abundance) demonstrating the use of ion activation in the source region of a hybrid ion mobility-mass spectrometer to improve the desolvation and declustering of gas phase ions. The top plot shows the mass spectrum and the drift time vs. m/z abundance plot for 0 V collision energy and the bottom plot shows the data for 450 V collision energy. The mass spectral peak profiles for the high-energy experiments exhibit the improved declustering for BSA native spray ions at charge states +16 to +19. This improved desolvation and declustering is very important for intact protein analysis using mass spectrometry, especially for native electrospray analysis.

Figure 7A:
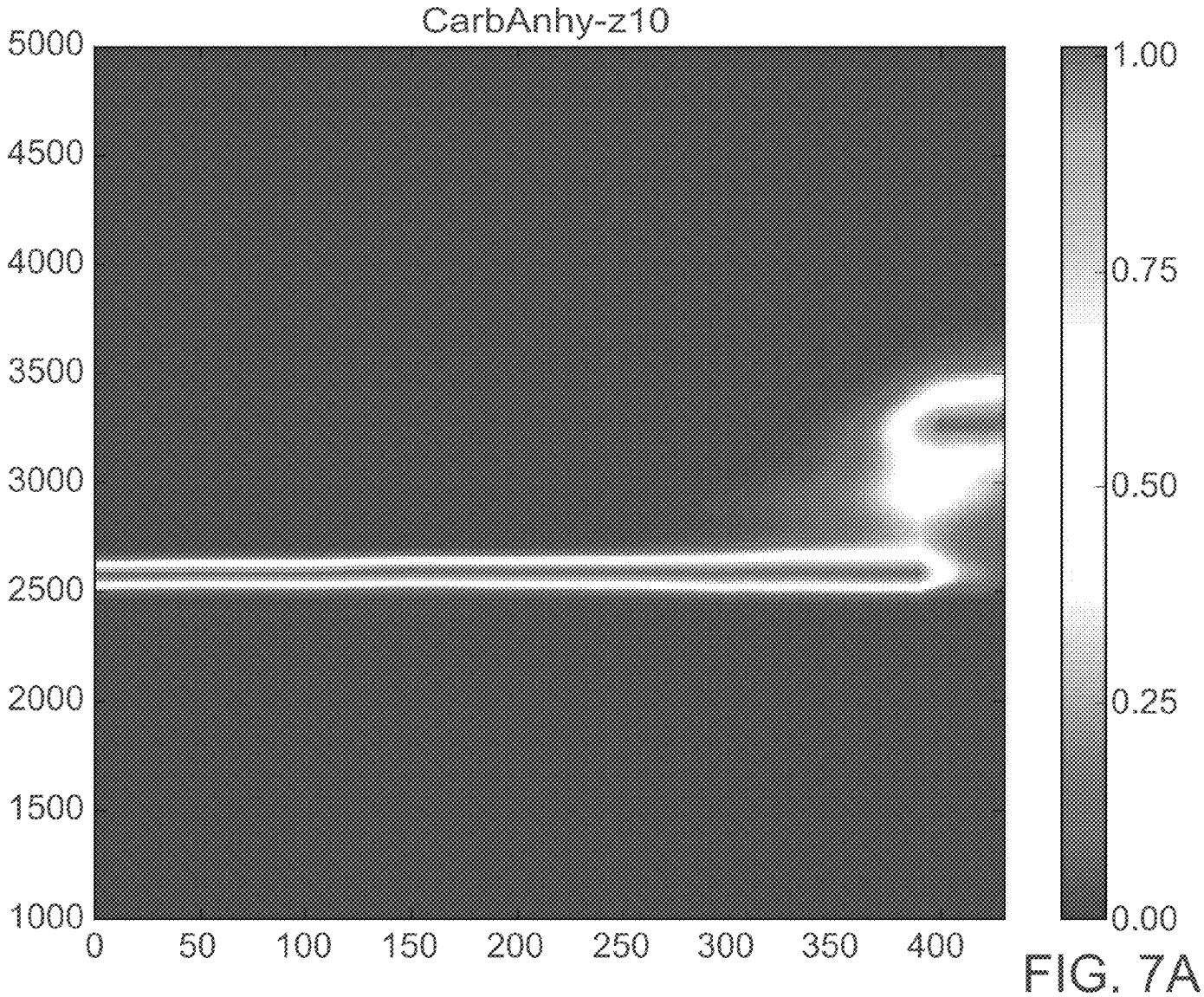
FIGS. 7A, 7B, and 7C show three respective plots of data (CCS vs. CE) demonstrating the use of in-source ion activation and protein unfolding coupled with ion mobility separation prior to mass spectrometry analysis for protein structural characterization, according to an embodiment disclosed herein.
Figure 7B:
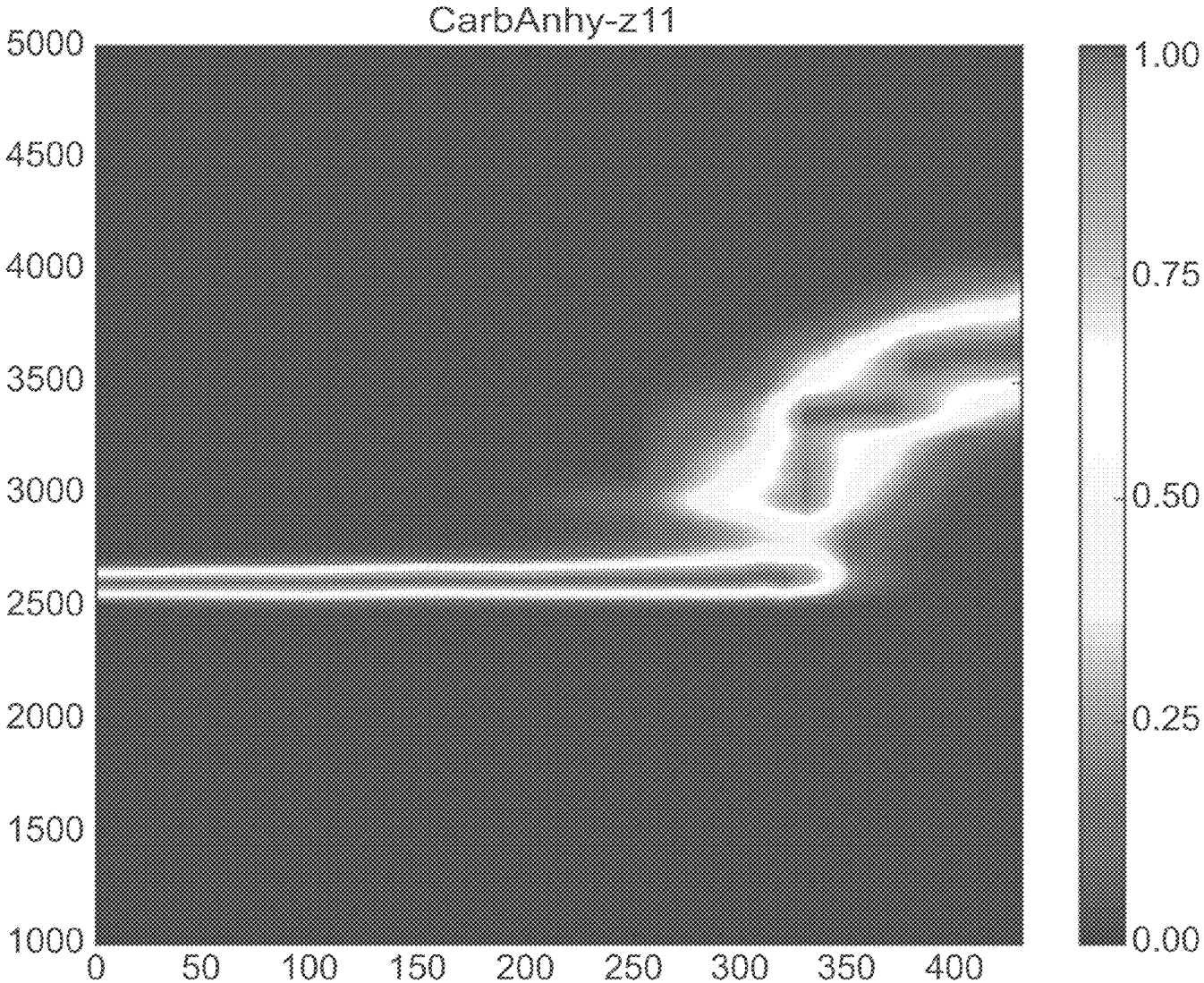
Figure 7C:
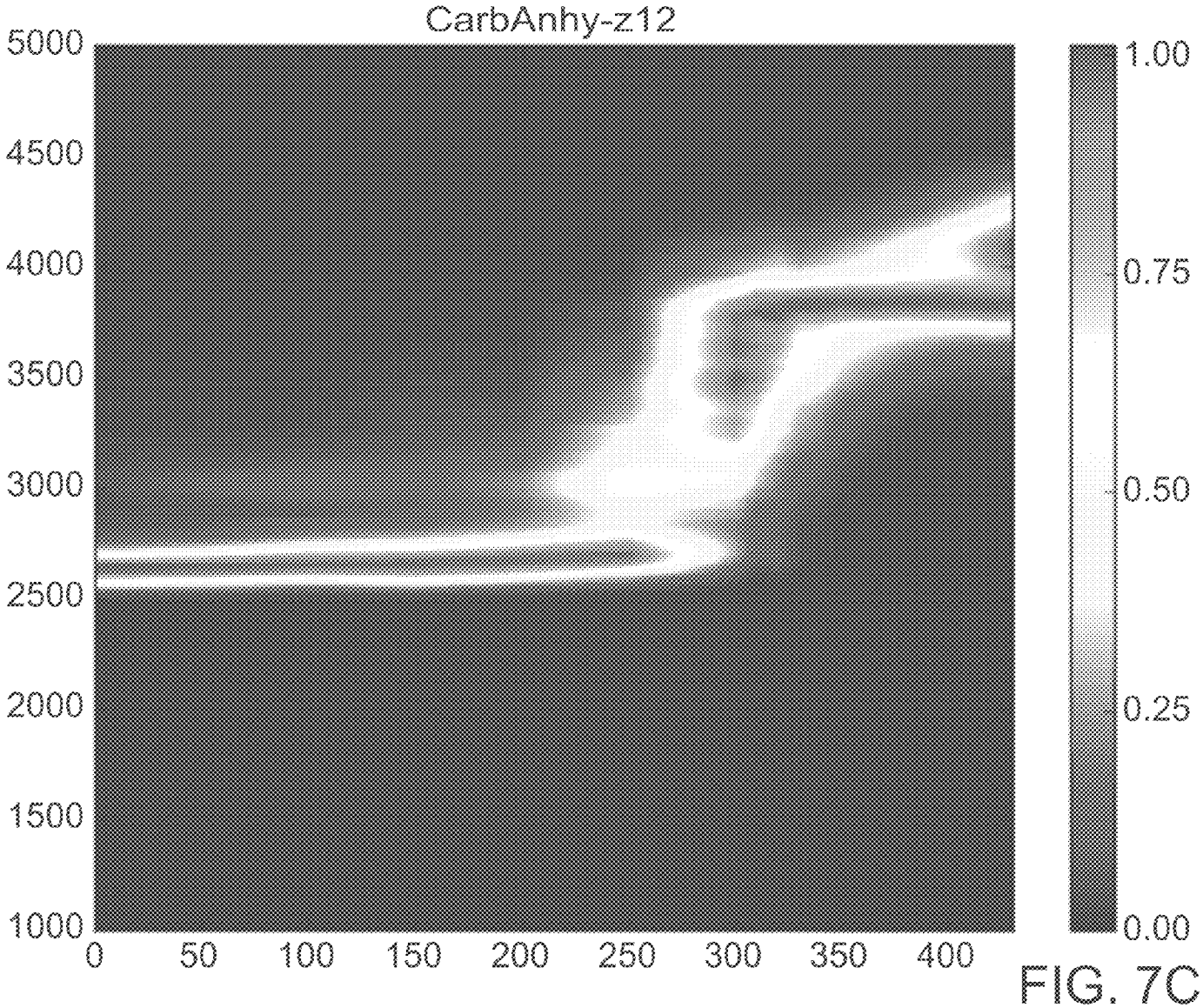

FIGS. 7A, 7B, and 7C show three respective plots of data (CCS vs. CE) demonstrating the use of in-source ion activation and protein unfolding coupled with ion mobility separation prior to mass spectrometry analysis for protein structural characterization. Collision-induced unfolding plots for three different charge state ions (+10 to +12) for native electrospray ionization of carbonic anhydrase protein are shown. Each charge state ion shows characteristic unfolding patterns through specific structural transitions. These unique structural transitions can be used as a means to identify different proteins with similar masses that are difficult to identify using mass spectrometry techniques alone.

In a typical embodiment, the ionization device utilized in an ion source as disclosed herein is an atmospheric pressure ionization (API) device. Examples of API ionization devices include, but are not limited to, spray-type devices (electrospray ionization (ESI) devices, thermospray ionization devices, etc.), atmospheric-pressure chemical ionization (APCI) devices, atmospheric-pressure photoionization (APPI) devices, atmospheric-pressure laser desorption ionization (AP-LDI) devices, atmospheric-pressure matrix-assisted laser desorption ionization (AP-MALDI) devices, atmospheric-pressure plasma-based devices, etc. The sample to be ionized and analyzed may be introduced to the ion source by any suitable means, including hyphenated techniques in which the sample is an output of an analytical separation instrument such as, for example, a gas chromatography (GC) or liquid chromatography (LC) instrument.

In addition to the funnel-based ion trap described above, examples of other ion traps that may be utilized in a spectrometry system as disclosed herein include, but are not limited to, ion traps based on two-dimensional (linear) and three-dimensional multipole electrode arrangements. Alternatively, the ionization device and ionization chamber provided may be configured to provide the functions of ion accumulation and pulsing, in which case a separate ion trap may not be provided.

An ion fragmentation device provided in a spectrometry system as disclosed herein may include a collision cell as described above, or may have a configuration other than a CID-based device. For example, the ion fragmentation device may be configured to perform electron capture dissociation (ECD), electron transfer dissociation (ETD), infrared multiphoton dissociation (IRMPD), etc.

In a typical embodiment, a spectrometry system as disclosed herein may include a quadrupole mass filter as a first mass analyzer and a TOF analyzer as a second mass analyzer. More generally, however, various types of mass analyzers may be utilized in the spectrometry system. Examples include, but are not limited to, multipole electrode structures (e.g., quadrupole mass filters, linear ion traps, three-dimensional Paul traps, etc.), electrostatic traps (e.g. Kingdon, Knight and ORBITRAP® traps), ion cyclotron resonance (ICR) or Penning traps (such as utilized in Fourier transform ion cyclotron resonance mass spectrometry (FT-ICR or FTMS)), electric field sector instruments, magnetic field sector instruments, etc.

An ion detector provided in a spectrometry system as disclosed herein may be, for example, an electron multiplier (EM), micro-channel plate (MCP) detector, a Faraday cup, etc.

As appreciated by persons skilled in the art, a spectrometry system as disclosed herein may include various other ion optics positioned along the ion path that are not specifically described above or shown in the drawing figures. Such ion optics may be configured for controlling or manipulating (e.g., focusing, shaping, steering, cooling, accelerating, decelerating, slicing, etc.) the ion beam, as appreciated by persons skilled in the art.

The controller 176 schematically depicted in FIG. 1 may represent one or more modules, control units, components, or the like configured for controlling, monitoring and/or timing the operation of various devices that may be provided in a spectrometry system as disclosed herein. As described above, the controller 176 may control, or execute a preprogrammed operation of, the voltage source 142 or 242 and consequently control the electric fields and collision energies realized in the reduced-pressure chamber 128 of the ion source 102 or 302 (FIGS. 1-3). The controller 176 may communicate with and control other devices that may be associated with the ion source 102 or 302 and the spectrometer 106 or 306 such as, for example, the ionization device, ion funnels and other ion guides, ion trap, IM analyzer (e.g., drift cell), mass filter, collision cell or other ion fragmentation device, TOF analyzer or other mass analyzer, ion detector, vacuum system, ion optics, sample introduction device, upstream LC or GC instrument, etc. One or more modules of the controller 176 may be, or be embodied in, for example, a computer workstation, desktop computer, laptop computer, portable computer, tablet computer, handheld computer, mobile computing device, personal digital assistant (PDA), smartphone, etc. The controller 176 may also schematically represent all electronic components not specifically shown in FIGS. 1-3 that may be needed for practical operation of the spectrometry system, such as, for example, voltage sources, timing controllers, clocks, frequency/waveform generators, processors, logic circuits, memories, databases, etc. The controller 176 may also be configured for receiving the ion measurement signals from the ion detector and performing tasks relating to data acquisition and signal analysis as necessary to generate chromatograms, drift spectra, CCS spectra, and mass spectra characterizing the sample under analysis. The controller 176 may also be configured for providing and controlling a user interface that provides screen displays of spectrometric data and other data with which a user may interact. The controller 176 may also be configured for executing data processing algorithms such as feature finders. The controller 176 may include one or more reading devices on or in which a non-transitory or tangible computer-readable (machine-readable) medium may be loaded that includes instructions for performing all or part of any of the methods disclosed herein. For all such purposes, the controller 176 may be in electrical communication with various components of the spectrometry system via wired or wireless communication links (as partially represented by a dashed line between the controller 126 and the ion detector 150 in FIG. 1). Also for these purposes, the controller 176 may include one or more types of hardware, firmware and/or software, as appreciated by persons skilled in the art.

Exemplary Embodiments

Exemplary embodiments provided in accordance with the presently disclosed subject matter include, but are not limited to, the following:

1. An ion source, comprising:

an atmospheric-pressure ionization chamber;

a reduced-pressure chamber configured for maintaining a high sub-atmospheric pressure therein;

an ion transfer device comprising an inlet in the ionization chamber and an outlet in the reduced-pressure chamber, and defining an ion path from the inlet to the outlet;

an electrode assembly comprising at least a first electrode positioned in the reduced-pressure chamber at an outlet-electrode distance from the outlet; and a voltage source configured for imparting a potential difference between the ion transfer device and the electrode assembly to accelerate ions emitted from the outlet to a collision energy, wherein the collision energy is effective to cause collisional heating of ions in the reduced-pressure chamber without voltage breakdown.

2. The ion source of embodiment 1, wherein the reduced-pressure chamber is configured for maintaining the high sub-atmospheric pressure in a range from about 0.5 Torr to about 30 Torr.

3. The ion source of any of the preceding embodiments, comprising a vacuum system configured for reducing the reduced-pressure chamber to the high sub-atmospheric pressure.

4. The ion source of any of the preceding embodiments, wherein the outlet-electrode distance is in a range between about 0.5 mm to about 3.0 mm.

5. The ion source of any of the preceding embodiments, wherein the outlet and the first electrode are positioned on an axis, and the first electrode comprises a planar section having an aperture on the axis.

6. The ion source of embodiment 5, wherein the planar section comprises a plate or a grid.

7. The ion source of any of the preceding embodiments, wherein the outlet and the first electrode are positioned on an axis, and the first electrode comprises a cylindrical section coaxial with the axis.

8. The ion source of any of the preceding embodiments, wherein the electrode assembly comprises a plurality of electrodes in the reduced-pressure chamber, and the plurality of electrodes comprises the first electrode.

9. The ion source of embodiment 8, wherein:

the plurality of electrodes comprises a second electrode positioned at an electrode-electrode distance from the first electrode; and the voltage source is configured for imparting the potential difference between the ion transfer device and the electrode assembly as a first potential difference between the ion transfer device and the first electrode and a second potential difference between the first electrode and the second electrode.

10. The ion source of embodiment 9, wherein the first potential difference is less than the second potential difference.

11. The ion source of embodiment 9 or 10, wherein the electrode-electrode distance is in a range between about 0.5 mm to about 3.0 mm.

12. The ion source of any of embodiments 9-11, wherein the outlet, the first electrode, and the second electrode are positioned on an axis, the first electrode comprises a first planar section having an aperture on the axis, and the second electrode comprises a second planar section having an aperture on the axis.

13. The ion source of any of embodiments 9-12, wherein the outlet, the first electrode, and the second electrode are positioned on an axis, the first electrode comprises a first cylindrical section coaxial with the axis, and the second electrode comprises a second cylindrical section coaxial with the axis.

14. The ion source of embodiment 13, wherein at least a portion of the second cylindrical section coaxially surrounds the first cylindrical section.

15. The ion source of any of the preceding embodiments, wherein the ion transfer device comprises a capillary tube terminating at the outlet.

16. The ion source of embodiment 11, wherein the capillary tube is disposed along an axis and the electrode assembly is positioned on the axis.

17. The ion source of any of the preceding embodiments, wherein the voltage source is configured for imparting the potential difference in a range from about 0 V to about 1000 V.

18. The ion source of any of the preceding embodiments, wherein the voltage source is configured for imparting the potential difference high enough to raise the collision energy to a value selected from the group consisting of:

a value effective to promote desolvation of solvated ions emitted from the outlet;

a value effective to promote declustering of cluster ions emitted from the outlet;

a value effective to unfold folded biomolecular ions emitted from the outlet by collision-induced unfolding;

a value effective to unfold folded biomolecular ions emitted from the outlet by collision-induced unfolding without dissociating the biomolecular ions; and a value effective to dissociate ions emitted from the outlet by collision-induced dissociation.

19. The ion source of any of the preceding embodiments, comprising an ion guide in the reduced-pressure chamber positioned along an ion guide axis.

20. The ion source of embodiment 19, wherein the ion guide is configured for generating a radio frequency electric field effective for limiting radial motion of ions relative to the ion guide axis.

21. The ion source of embodiment 19 or 20, wherein the ion guide is configured for generating a direct-current potential gradient along the ion guide axis.

22. The ion source of any of embodiments 19-21, wherein the ion guide comprises an ion guide entrance and an ion guide exit spaced from the ion guide entrance along the ion guide axis, and the ion guide entrance surrounds at least a portion of the electrode assembly.

23. The ion source of any of embodiments 19-22, wherein the ion guide comprises an ion funnel.

24. The ion source of any of embodiments 19-23, wherein the ion guide comprises a plurality of ion guide electrodes spaced from each other along the ion guide axis and comprising a plurality of respective ion guide apertures.

25. The ion source of any of embodiments 19-24, wherein the outlet is positioned on an outlet axis radially offset from the ion guide axis.

26. The ion source of any of embodiments 19-25, wherein the ion guide is a first ion guide and the ion guide axis is a first ion guide axis, and further comprising a second ion guide positioned along a second ion guide axis and configured to receive ions from the first ion guide.

27. The ion source of embodiment 26, wherein the second ion guide is configured for generating an electric field effective for trapping ions in the second ion guide for a controllable period of time.

28. The ion source of embodiment 26 or 27, wherein the second ion guide comprises an ion funnel.

29. The ion source of any of embodiments 26-28, wherein the second ion guide comprises plurality of ion guide electrodes spaced from each other along the ion guide axis and comprising a plurality of respective ion guide apertures.

30. The ion source of any of embodiments 26-29, wherein the second ion guide axis is radially offset from the first ion guide axis.

31. The ion source of any of the preceding embodiments, comprising an ionization device configured for producing ions in the ionization chamber from a sample by atmospheric-pressure ionization.

32. The ion source of embodiment 31, wherein the ionization device is selected from the group consisting of: spray-based ionization; electrospray ionization; thermospray ionization; sonic spray ionization; atmospheric-pressure chemical ionization; ambient ionization; atmospheric-pressure photoionization; laser-based ionization; plasma-based ionization; laser desorption/ionization; and matrix-assisted laser desorption/ionization.

33. The ion source of any of the preceding embodiments, wherein the reduced-pressure chamber does not include a skimmer.

34. A spectrometry system, comprising:

the ion source of any of the preceding embodiments;

a vacuum housing configured for receiving ions from the reduced-pressure chamber; and an ion analyzer in the vacuum housing.

35. The spectrometry system of embodiment 34, wherein the ion analyzer comprises an ion mobility drift cell or a mass analyzer.

36. The spectrometry system of embodiment 34 or 35, wherein the ion analyzer is a first ion analyzer, and further comprising a second ion analyzer configured for receiving ions from the first ion analyzer.

37. The spectrometry system of embodiment 36, wherein the first ion analyzer is an ion mobility drift cell and the second ion analyzer is a mass analyzer.

38. The spectrometry system of embodiment 36, wherein:

the first ion analyzer is an ion mobility drift cell; and the second ion analyzer is a mass spectrometer comprising a first mass analyzer, a collision cell configured for receiving ions from the first mass analyzer, and a second mass analyzer configured for receiving ions from the collision cell.

39. A method for analyzing a sample, the method comprising:

performing atmospheric-pressure ionization to produce ions from the sample in an ionization chamber;

transferring the ions into a reduced-pressure chamber maintained at a high sub-atmospheric pressure; and subjecting the ions transferred into the reduced-pressure chamber to an electric field that accelerates the ions to a collision energy, wherein the collision energy is effective to cause collisional heating of ions in the reduced-pressure chamber without voltage breakdown.

40. The method of embodiment 39, comprising maintaining the reduced-pressure chamber at a pressure in a range between about 0.5 Torr to about 30 Torr.

41. The method of embodiment 39 or 40, wherein transferring the ions comprises transferring the ions through an ion transfer device, and subjecting the ions to the electric field comprises imparting a potential difference between the ion transfer device and an electrode assembly in the reduced-pressure chamber to accelerate the ions to the collision energy.

42. The method of embodiment 41, comprising imparting the potential difference in a range from about 0 V to about 1000 V.

43. The method of any of embodiments 39-41, wherein the collision energy is selected from the group consisting of:

a collision energy effective to promote desolvation of solvated ions emitted from the outlet;

a collision energy effective to promote declustering of cluster ions emitted from the outlet;

a collision energy effective to unfold folded biomolecular ions emitted from the outlet by collision-induced unfolding;

a collision energy effective to unfold folded biomolecular ions emitted from the outlet by collision-induced unfolding without dissociating the biomolecular ions; and a collision energy effective to dissociate ions emitted from the outlet by collision-induced dissociation.

44. The method of any of embodiments 39-41, comprising, after transferring the ions into the reduced-pressure chamber, transferring the ions into an ion mobility drift cell.

45. The method of embodiment 44, comprising, after transferring the ions into the ion mobility drift cell, transferring the ions to an ion detector.

46. The method of embodiment 45, comprising measuring respective arrival times of the ions at the ion detector relative to a time at which the ions were transferred into the ion mobility drift cell.

47. The method of embodiment 46, comprising, based on the measured arrival times, calculating an arrival time distribution of the ions, or calculating collision cross-sections of the ions, or both.

48. The method of embodiment 47, wherein the ions transferred into the reduced-pressure chamber comprise folded biomolecular ions, the collision energy is effective to unfold the folded biomolecular ions, and measuring respective arrival times comprises measuring respective arrival times of the unfolded ions.

49. The method of embodiment 47 or 48, wherein the collision energy is effective to produce fragment ions by collision-induced dissociation, and measuring respective arrival times comprises measuring respective arrival times of the fragment ions.

50. The method of any of embodiments 39-49, comprising, after transferring the ions into the reduced-pressure chamber, transferring the ions into a mass analyzer.

51. The method of embodiment 50, comprising, after transferring the ions into the mass analyzer, transferring the ions to an ion detector and producing a mass spectrum of the ions.

52. The method of embodiment 51, wherein the collision energy is effective to produce fragment ions by collision-induced dissociation, and producing the mass spectrum comprises producing a mass spectrum of the fragment ions.

53. The method of embodiment 50, comprising, after transferring the ions into the reduced-pressure chamber, transferring the ions into an ion mobility drift cell, followed by transferring the ions into the mass analyzer.

54. The method of embodiment 53, comprising, after transferring the ions into the mass analyzer, transferring the ions to an ion detector and producing an ion mobility drift time spectrum and a mass spectrum of the ions.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the controller 176 schematically depicted in FIG. 1. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), application specific integrated circuits (ASICs), or field-programmable gate arrays (FPGAs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the controller 176 shown in FIG. 1), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" or "in electrical communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion source, comprising:

an atmospheric-pressure ionization chamber;

a reduced-pressure chamber configured for maintaining a high sub-atmospheric pressure therein;

an ion transfer device comprising an inlet in the ionization chamber and an outlet in the reduced-pressure chamber, and defining an ion path from the inlet to the outlet;

an electrode assembly comprising at least a first electrode positioned in the reduced-pressure chamber at an outlet-electrode distance from the outlet; and a voltage source configured for imparting a potential difference between the ion transfer device and the electrode assembly to accelerate ions emitted from the outlet to a collision energy, wherein the collision energy is effective to cause collisional heating of ions in the reduced-pressure chamber without voltage breakdown.

2. The ion source of claim 1, wherein the reduced-pressure chamber is configured for maintaining the high sub-atmospheric pressure in a range from about 0.5 Torr to about 30 Torr.

3. The ion source of claim 1, wherein the outlet and the first electrode are positioned on an axis, and the first electrode has a configuration selected from the group consisting of:

the first electrode comprises a planar section having an aperture on the axis;

the first electrode comprises a plate having an aperture on the axis;

the first electrode comprises a grid;

the first electrode comprises a cylindrical section coaxial with the axis; and a combination of two or more of the foregoing.

4. The ion source of claim 1, wherein the electrode assembly comprises a plurality of electrodes in the reduced-pressure chamber, and the plurality of electrodes comprises the first electrode.

5. The ion source of claim 4, wherein:

the plurality of electrodes comprises a second electrode positioned at an electrode-electrode distance from the first electrode; and the voltage source is configured for imparting the potential difference between the ion transfer device and the electrode assembly as a first potential difference between the ion transfer device and the first electrode and a second potential difference between the first electrode and the second electrode.

6. The ion source of claim 5, wherein the outlet, the first electrode, and the second electrode are positioned on an axis, the first electrode and the second electrode have a configuration selected from the group consisting of:

the first electrode comprises a first planar section having an aperture on the axis, and the second electrode comprises a second planar section having an aperture on the axis;

the first electrode comprises a first cylindrical section coaxial with the axis, and the second electrode comprises a second cylindrical section coaxial with the axis;

the first electrode comprises a first cylindrical section coaxial with the axis, the second electrode comprises a second cylindrical section coaxial with the axis, and at least a portion of the second cylindrical section coaxially surrounds the first cylindrical section; and a combination of two or more of the foregoing.

7. The ion source of claim 1, wherein the voltage source is configured for imparting the potential difference high enough to raise the collision energy to a value selected from the group consisting of:

a value effective to promote desolvation of solvated ions emitted from the outlet;

a value effective to promote declustering of cluster ions emitted from the outlet;

a value effective to unfold folded biomolecular ions emitted from the outlet by collision-induced unfolding;

a value effective to unfold folded biomolecular ions emitted from the outlet by collision-induced unfolding without dissociating the biomolecular ions; and a value effective to dissociate ions emitted from the outlet by collision-induced dissociation.

8. The ion source of claim 1, comprising an ion guide in the reduced-pressure chamber positioned along an ion guide axis.

9. The ion source of claim 8, wherein the ion guide comprises an ion guide entrance and an ion guide exit spaced from the ion guide entrance along the ion guide axis, and the ion guide entrance surrounds at least a portion of the electrode assembly.

10. The ion source of any of claim 8, wherein the outlet is positioned on an outlet axis radially offset from the ion guide axis.

11. The ion source of claim 1, wherein the reduced-pressure chamber does not include a skimmer.

12. A method for analyzing a sample, the method comprising:

performing atmospheric-pressure ionization to produce ions from the sample in an ionization chamber;

transferring the ions into a reduced-pressure chamber maintained at a high sub-atmospheric pressure; and subjecting the ions transferred into the reduced-pressure chamber to an electric field that accelerates the ions to a collision energy, wherein the collision energy is effective to cause collisional heating of ions in the reduced-pressure chamber without voltage breakdown.

13. The method of claim 12, wherein transferring the ions comprises transferring the ions through an ion transfer device, and subjecting the ions to the electric field comprises imparting a potential difference between the ion transfer device and an electrode assembly in the reduced-pressure chamber to accelerate the ions to the collision energy.

14. The method of claim 12, wherein the collision energy is selected from the group consisting of:

a collision energy effective to promote desolvation of solvated ions emitted from the outlet;

a collision energy effective to promote declustering of cluster ions emitted from the outlet;

a collision energy effective to unfold folded biomolecular ions emitted from the outlet by collision-induced unfolding;

a collision energy effective to unfold folded biomolecular ions emitted from the outlet by collision-induced unfolding without dissociating the biomolecular ions; and a collision energy effective to dissociate ions emitted from the outlet by collision-induced dissociation.

15. The method of claim 12, comprising, after transferring the ions into the reduced-pressure chamber, transferring the ions into an ion mobility drift cell.

16. The method of claim 15, comprising, after transferring the ions into the ion mobility drift cell, transferring the ions to an ion detector.

17. The method of claim 16, comprising measuring respective arrival times of the ions at the ion detector relative to a time at which the ions were transferred into the ion mobility drift cell.

18. The method of claim 17, comprising, based on the measured arrival times, calculating an arrival time distribution of the ions, or calculating collision cross-sections of the ions, or both.

19. The method of claim 18, wherein the ions transferred into the reduced-pressure chamber comprise folded biomolecular ions, the collision energy is effective to unfold the folded biomolecular ions, and measuring respective arrival times comprises measuring respective arrival times of the unfolded ions.

20. The method of claim 18, wherein the collision energy is effective to produce fragment ions by collision-induced dissociation, and measuring respective arrival times comprises measuring respective arrival times of the fragment ions.

* * * * *